US006604807B1

(12) United States Patent
Murcia et al.

(10) Patent No.: US 6,604,807 B1
(45) Date of Patent: Aug. 12, 2003

(54) METHOD AND APPARATUS FOR DETECTING ANOMALOUS NOZZLES IN AN INK JET PRINTER DEVICE

(75) Inventors: Antoni Murcia, Barcelona (ES); Xavier Bruch, Barcelona (ES); Josë Luís Valero, Barcelona (ES); Xavier Girones, Tarragona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/252,706

(22) Filed: Feb. 18, 1999

(51) Int. Cl.[7] ..... B41J 29/393
(52) U.S. Cl. ..... 347/19
(58) Field of Search ..... 347/19, 23; 73/861.41; 250/573

(56) References Cited

U.S. PATENT DOCUMENTS 4,751,517 A * 6/1988 Crean et al. ..... 347/81
4,907,013 A * 3/1990 Hubbard et al. ..... 347/19
5,036,340 A * 7/1991 Osborne ..... 347/19
5,276,467 A * 1/1994 Meyer et al. ..... 347/19
5,304,814 A * 4/1994 Markham ..... 250/573
5,430,306 A * 7/1995 Ix ..... 347/19
5,434,430 A * 7/1995 Stewart ..... 347/19
5,521,620 A * 5/1996 Becerra et al. ..... 347/19
5,559,339 A * 9/1996 Domanik et al. ..... 250/573
5,621,524 A * 4/1997 Mitani ..... 347/19
5,627,571 A * 5/1997 Anderson et al. ..... 347/19
6,048,045 A * 4/2000 Nohata et al. ..... 347/19
6,350,006 B1 * 2/2002 Muller et al. ..... 347/19

* cited by examiner

*Primary Examiner*—John Barlow
*Assistant Examiner*—Julian D. Huffman

(57) ABSTRACT

A method for detecting clogged or otherwise anomalous nozzles in an ink jet printing device having a printer head containing at least one nozzle configured to eject droplets of ink, the method including sending an instruction to the printer head to eject droplets of ink, generating an output signal from a detecting means configured to detect a passage of droplets past the detecting means and applying an algorithm to the output signal which is configurable to check a correct functioning of the nozzles.

21 Claims, 16 Drawing Sheets

METHOD AND APPARATUS FOR DETECTING ANOMALOUS NOZZLES IN AN INK JET PRINTER DEVICE

FIELD OF THE INVENTION

The present invention relates to printer devices, and particularly although not exclusively to a method and apparatus for improving the detection of faulty or clogged nozzles in printer devices.

BACKGROUND TO THE INVENTION

It is known to produce paper copies, also known as "hard" copies, of files stored on a host device, e.g. a computer using a printer device. The print media onto which files may be printed includes paper and clear acetates.

Referring to FIG. 1 herein, there is illustrated a conventional host device 100 capable of generating print signals, in this case a personal computer, linked to a printer device 120 via a cable 110. Amongst the known methods for printing text and the like onto a print medium such as paper it is known to build up an image on the paper by spraying droplets of ink from a plurality of nozzles. Printers operating such methods are known as "ink-jet printers".

Referring to FIG. 2 herein, there is illustrated schematically part of a prior art ink-jet printer device comprising an array of printer nozzles 220 arranged into a plurality of parallel rows. The unit comprising the arrangement of printer nozzles is known herein as a printer head. In a conventional printer of the type described herein the printer head 210 is constrained to move in a first direction 260 with respect to a print medium 200 e.g. a sheet of A4 paper. In addition, the print medium 200 is also constrained to move in a further, second direction 250 which is preferably substantially orthogonal to the first direction 260. During a normal printing to a print media, printer head 210 is moved into a first position with respect to the print medium 200 and a plurality of ink droplets, e.g., 230 and 240, are sprayed from a same plurality of printer nozzles 220 contained within printer head 210. After the completion of a print operation the printer head 210 is moved in a direction 260 to a second position and another print operation is performed. In a like manner, the printer head is repeatedly moved in a direction 260 across the print medium 200 and a print operation performed after each such movement of the print head 210. When the printer head 210 reaches an edge of the print medium 200, the print medium is moved a short distance in second direction 250, parallel to a main length of the print medium 200, and another print operation is performed. The printer head 210 is then moved in first direction 260 back across the print medium 200 and another print operation is performed. In this manner, a complete printed page is produced, as the print head moves backwards and forwards across the print medium in a direction of travel transverse to the direction of travel of the print medium.

In order to maintain the quality of the printed output of the printer device it is important that each instruction to the printer head to produce an ink drop from a nozzle of the plurality of nozzles does indeed produce such an ink drop. In conventional printers it is known to attempt to detect an ink drop as it leaves the nozzle during a normal print operation. In conventional printers this drop detection is used to indicate the end of life of the printer head 210. Drop detection is known to be performed by a drop detection assembly 270. It is known to locate the drop detection assembly 270 outside of the region used for printing onto the print medium 200 and it is known to locate the drop detection assembly 270 close to an edge of the print medium 200.

U.S. Pat. No. 5,835,108 (Hewlett-Packard) discloses a prior art method and apparatus for detecting and compensating for nozzles or groups of nozzles in print head of an inkjet printer device which mis-direct ink drops on the print media. Mis-directed nozzles are detected by ejecting ink droplets from a first group of nozzles onto a first region of a test pattern and ejecting ink droplets from a second group of nozzles onto a second region of the test pattern. An optical sensor is used to scan across the test pattern in order to detect the positions of the ejected ink droplets on the test pattern.

Since the method disclosed in U.S. Pat. No. 5,835,108 necessitates the use of a scanning device which is mechanically tracked across a special test pattern during a scanning operation, this contributes to the complexity and hence cost of the printing device. Additionally, the scanning operation must require a time substantially longer than the period of time between ejection of ink droplets from a nozzle and the ink droplets striking the print media.

While the presence or absence of an ink droplet fired from a printer head will clearly have an effect on print quality unless it is corrected for, there are other variables which may also have an effect on the quality of the printed output. In particular, variability in the ink droplet volume and deflection of the ink droplet from its true path can result in thin or misplaced lines on the printed page. In art order to optimize print quality it is important to obtain more information regarding the characteristics of an ink droplet fired from a nozzle of a printer head other than simply whether or not a droplet has been fired.

SUMMARY OF THE INVENTION

The specific embodiments and methods according to the present invention aim to improve the detection of anomalous nozzles in ink jet printer devices comprising a plurality of nozzles, thereby improving the resulting print quality of such printer devices. Anomalous nozzles may include nozzles which eject a smaller drop volume than expected, or which eject a larger drop volume than expected, nozzles which misfire, nozzles which operate intermittently, and nozzles which are misdirected.

Specific methods according to the present invention, recognize that by comparing a sequence of measurements of an ink droplet ejected from a nozzle near a drop detection device with measurements of ink droplets ejected from adjacent nozzles, misfiring nozzles may be identified and corrected for prior to printing.

According to a first aspect of the present invention, there is provided a method of determining an operating characteristic of a printer head comprising a plurality of nozzles each configured to eject a plurality of droplets of ink, said method comprising the steps of:

- detecting a signal resulting from ejection of a predetermined sequence of ink drops from a selected said nozzle;
- for each of a set of said plurality of said nozzles, detecting a corresponding respective signal resulting from ejection of a corresponding predetermined sequence of ink drops;
- determining a generic signal response from said plurality of detected signal responses of said set of nozzles; and
- comparing said detected signal of said selected nozzle with said generic signal determined from said set of nozzles.

Preferably, the method comprises the step of determining a difference between said signal of said selected nozzle and said generic signal determined from said set of nozzles.

According to a second aspect of the present invention, there is provided a method for checking a functionality of at least one selected nozzle of a printer head containing a plurality of nozzles configured to eject droplets of ink, said method comprising the steps of:

sending an instruction to said printer head to eject a predetermined sequence of droplets of ink from said at least one selected nozzle;

generating an output signal from a detecting means configured to detect a passage of said predetermined sequence of droplets of ink past said detecting means; and applying an algorithm to said output signal to generate an error signal which identifies an anomalous behaviour of said at least one selected nozzle.

Preferably, said predetermined sequence of ink droplets comprises at least one droplet of ink configured such that a total volume of ink of said predetermined at least one droplet lies within a specified range of volume.

Preferably, a total volume of ink contained in said predetermined sequence of droplets is configured to produce an output signal having a substantially larger amplitude than a typical noise amplitude introduced by said detecting means.

Preferably, said predetermined sequence of ink droplets contain a total ink volume substantially within the range 4 picolitres to 100 picolitres.

The method may further comprise the steps of;

for each nozzle of a set of nozzles of said plurality of nozzles, sending an instruction to a print head to eject a predetermined sequence of ink droplets from said nozzle;

for each nozzle of said set, generating a corresponding respective output signal from said detecting means;

wherein said step of applying an algorithm to said output signal comprises the steps of:

determining an average output signal of said detecting means for a plurality of output signals corresponding to said set of nozzles;

calculating a difference between said average output signal and an output signal of said detecting means corresponding to said at least one selected nozzle;

calculating a square of said difference between said average output signal and said output signal of said selected nozzle;

adding said squared difference; and calculating a positive square root of said summed squared difference.

Said step of applying an algorithm to said output signal may comprise calculating a median output signal from a plurality of output signals corresponding to said set of nozzles.

Said step of applying an algorithm to said output signal may comprise:

finding a maximum value of output signal of said detecting means corresponding to a selected nozzle of said plurality of nozzles;

finding a minimum value of output signal from said detecting means corresponding to said selected nozzle of said plurality of nozzles;

calculating a peak-to-peak difference value between said maximum output signal value and said minimum output signal value of said selected nozzle;

for each of a set of said plurality of nozzles located substantially adjacent said selected nozzle, finding a maximum value of an output signal of said detecting means generated in response to a corresponding respective predetermined sequence of ink droplets ejected from said nozzle, and finding a minimum value of said output signal;

for each nozzle of a said set of nozzles, calculating a respective peak-to-peak output signal value;

calculating an average peak-to-peak value from said plurality of peak-to-peak signal values of said set of nozzles; and calculating a difference value requesting a difference between said peak-to-peak signal value of said selected nozzle, and said average peak-to-peak signal value of said set of nozzles.

Said step of applying an algorithm to said output signal to detect an anomalous behaviour of at least one nozzle may comprise the steps of:

for each nozzle of a set of said plurality of nozzles which lie adjacent a selected nozzle, generating an output signal in response to a predetermined sequence of ink droplets ejected from said nozzle;

for each generated output signal of said set of nozzles, calculating a first percentile value;

for each said generated output signal of said set of nozzles, calculating a second percentile value;

determining whether an output of said detecting means is greater than said first percentile value or less than said second percentile value;

if said output of said detecting means is less than said second percentile value then calculating a difference value between said output of said detecting means and said second percentile value, and squaring said difference value;

if said output of said detecting means is greater than said first percentile value calculating a difference value between said output of said detecting means and said first percentile value and squaring said difference value;

adding said squared difference values; and calculating a positive square root of said summed squared difference is values.

Said step of applying an algorithm to said output signal may comprise:

for each nozzle of a set of said plurality of nozzles which lie adjacent a selected nozzle, generating an output signal in response to a predetermined sequence of ink droplets ejected from said nozzle;

differentiating each said output signal of said detecting means for each nozzle of said set of nozzles;

differentiating said output signal obtained in response to said selected nozzle;

calculating an average differentiated output signal from said plurality of differentiated output signals;

calculating a difference between said differentiated output signal of said selected nozzle and said differentiated average output signal;

squaring said difference between said differentiated output signal of said selected nozzle and said differentiated average output signal;

summing said squared difference; and calculating a positive square root of said summed squared difference.

Said step of applying an algorithm to said output signal may comprise:

for each nozzle of a set of said plurality of nozzles which lie substantially adjacent to said selected nozzle, generating an output signal in response to a predetermined sequence of ink droplets ejected from said nozzle;

differentiating said output signal obtained in response to operation of said selected nozzle;

differentiating each of said output signals obtained in response to ink droplets ejected from said set up of nozzles;

normalising said differentiated output signals of said substantially adjacent nozzles such that said plurality of differentiated output signals have a same peak-to-peak value;

calculating an average differentiated signal from said plurality of normalised differentiated output signals;

calculating a difference between said differentiated output signal of said selected nozzle and said averaged differentiated output signal;

calculating a squared value of said difference;

summing said squared difference; and calculating a positive square root of said summed, squared difference.

The at least one nozzle may comprise an anomalous nozzle. An anomalous nozzle is characterized by having a malfunction within the set of malfunctions comprising in use, ejecting an ink droplet of a lower than expected ink volume; in use, ejecting an ink droplet of a higher than expected ink volume; in use, operating intermittently; in use, operating unreliably; and in use, ejecting a misdirected ink droplet with deviates from a predetermined trajectory path.

According to a third aspect of the present invention, there is provided a method of determining an operating characteristic of a selected nozzle of an ink jet printer head device comprising a plurality of nozzles, said method comprising the steps of:

obtaining for each nozzle of a set of nozzles, a corresponding respective nozzle signal output from a detecting means configured to detect a passage of at least one droplet of ink ejected from said nozzle;

obtaining for a selected nozzle a selected nozzle signal output from said detecting means;

determining an amount of perturbation of said selected nozzle signal;

obtaining a generic perturbation signal determined from each of said plurality of nozzle signals;

comparing said perturbation signal of said selected nozzle signal with said generic perturbation signal; and determining whether said selected nozzle corresponding to said selected nozzle signal is operating satisfactorily, based on said comparison of perturbation signals.

According to a fourth aspect of the present invention, there is provided a method of determining an operating characteristic of an ink jet printer head comprising a plurality of nozzles, said method comprising the steps of:

for each said nozzle, ejecting a predetermined sequence of ink droplets;

for a selected said nozzle, generating a corresponding respective perturbation signal having a perturbation produced in response to a said predetermined sequence of ink droplets ejected from said selected nozzle;

from said perturbation signal of said selected nozzle, generating a magnitude signal representing a magnitude of said perturbation;

for each of a set of said nozzles, generating a corresponding respective perturbation signal having a perturbation produced in response to a said predetermined sequence of ink droplets ejected from said nozzle;

generating a generic magnitude signal determined from said plurality of perturbation signals of said set of nozzles; and for said selected nozzle generating an error signal determined from said corresponding magnitude signal and said generic magnitude signal.

Preferably, said step of generating a magnitude signal comprises performing a plurality of amplitude samples over a plurality of time intervals on said perturbation signal.

Preferably, said plurality of nozzles are arranged in at least one row on said print head, and said generic magnitude signal is determined from a plurality of signal responses corresponding to ink droplets ejected from a plurality of nozzles in a same said row.

Preferably, said plurality of nozzles are arranged in at least one row on said print head, and said generic magnitude signal is determined from signals of a plurality of nozzles of a same row as a said selected nozzle, and extending on each side of said selected nozzle.

Said generic magnitude signal is determined as a median magnitude of said perturbation signals of said set of nozzles.

The invention includes a method of detecting at least one anomalous nozzle of an ink jet printer device comprising a plurality of nozzles arranged substantially in at least one row, said method comprising the steps of:

selecting a nozzle of said plurality of nozzles; and finding a maximum value of output signal of said detecting means corresponding to a said selected nozzle of said plurality of nozzles;

finding a minimum value of output signal from said detecting means corresponding to said selected nozzle of said plurality of nozzles;

calculating a peak-to-peak difference value between said maximum output signal value and said minimum output signal value of said selected nozzles;

for each of a set of said plurality of nozzles located substantially adjacent said selected nozzle, finding a maximum value of an output signal of said detecting means generated in response to a corresponding respective predetermined sequence of ink droplets ejected from said nozzle, and finding a minimum value of said output signals;

for each nozzle of a said set of nozzles, calculating a respective peak-to-peak output signal value;

calculating an average peak-to-peak signal value from said plurality of peak-to-peak signal values of said set of nozzles; and calculating a difference between said peak-to-peak signal value of said selected nozzle, and said average peak-to-peak signal value of said set of nozzles.

The invention includes a method of detecting at least one anomalous nozzle of an ink jet printer device comprising a plurality of nozzles arranged substantially in at least one row, said method comprising the steps of:

selecting individual ones of said plurality of nozzles and for each said selected nozzle;

generating an output signal in response to a predetermined sequence of ink droplets ejected from said selected nozzle;

for each generated output signal calculating a first percentile value;

for each said generated output signal calculating a second percentile value;

determining whether an output of said detecting means is greater than said first percentile value or less than said second percentile value;

if said output of said detecting means is less than said second percentile value then calculating a difference value between said output of said detecting means and said second percentile value, and squaring said difference values;

if said output of said detecting means is greater than said first percentile value calculating a difference value between said output of said detecting means and said first percentile value and squaring said difference value;

adding said squared difference values; and calculating a positive square root of said summed squared difference values.

The invention includes a method of detecting at least one anomalous nozzle of an ink jet printer device comprising a plurality of nozzles arranged substantially in at least one row, said method comprising the steps of:

selecting a said nozzle and generating an output signal in response to a predetermined sequence of ink droplets ejected from said selected nozzle;

for each nozzle of a set of said plurality of nozzles which lie adjacent said selected nozzle, generating an output signal in response to a predetermined sequence of ink droplets ejected from said each nozzle;

differentiating each said output signal of said detecting means for each nozzle of said set of nozzles;

differentiating said output signal obtained in response to said selected nozzle;

calculating an average differentiated output signal from said plurality of differentiated output signals obtained in response to said set of nozzles;

calculating a difference between said differentiated output signal of said selected nozzle and said differentiated average output signal;

squaring said difference between said differentiated output signal of said selected nozzle and said differentiated average output signal;

summing said squared difference; and calculating a positive square rot of said summed squared difference.

The invention includes a method of detecting at least one anomalous nozzle of an ink jet printer device comprising a plurality of nozzles arranged substantially in at least one row, said method comprising the steps of:

selecting a said nozzle and generating an output signal in response to a predetermined sequence of ink droplets ejected from said selected nozzle;

for each nozzle of a set of said plurality of nozzles which lie adjacent to said selected nozzle, generating an output signal in response to a predetermined sequence of ink droplets ejected from said each nozzle;

differentiating said output signal obtained in response to operation of said selected nozzle;

differentiating output signals of said detecting means obtained in response to said set of nozzles substantially adjacent to said selected nozzle;

normalising said differentiated output signals of said substantially adjacent nozzles such that said plurality of differentiated output signals have a same peak-to-peak value;

calculating an average signal from said normalised, differentiated output signals;

calculating differences between said differentiated output signal of said selected nozzle and said averaged differentiated output signal;

calculating a squared value of each of said differences;

summing said squared differences; and calculating a positive square root of said summed, squared differences.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described by way of example the best mode contemplated by the inventors for carrying out the invention. In the following description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

Specific methods according to the present invention described herein are aimed at printer devices having a printer head comprising a plurality of nozzles, each nozzle of the plurality of nozzles being configured to spray or eject a stream of droplets of ink. Printing to a print medium is performed by movement of the printer head relative to the print medium, as described herein before. However, it will be understood by those skilled in the art that the general methods disclosed and identified in the claims herein, are not limited to printer devices having a plurality of nozzles or printer devices with moving print heads.

Figure 1:
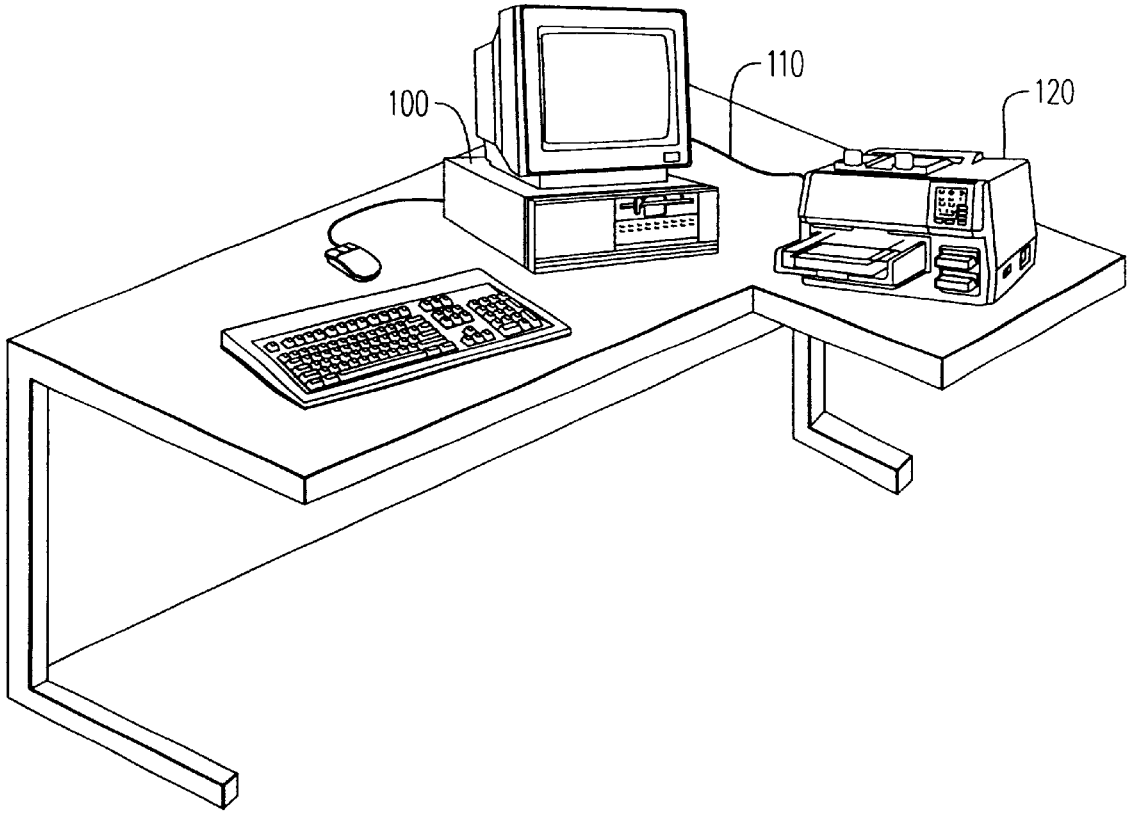
FIG. 1 (PRIOR ART)
FIG. 1 is a schematic representation of a conventional personal computer.
Figure 2:
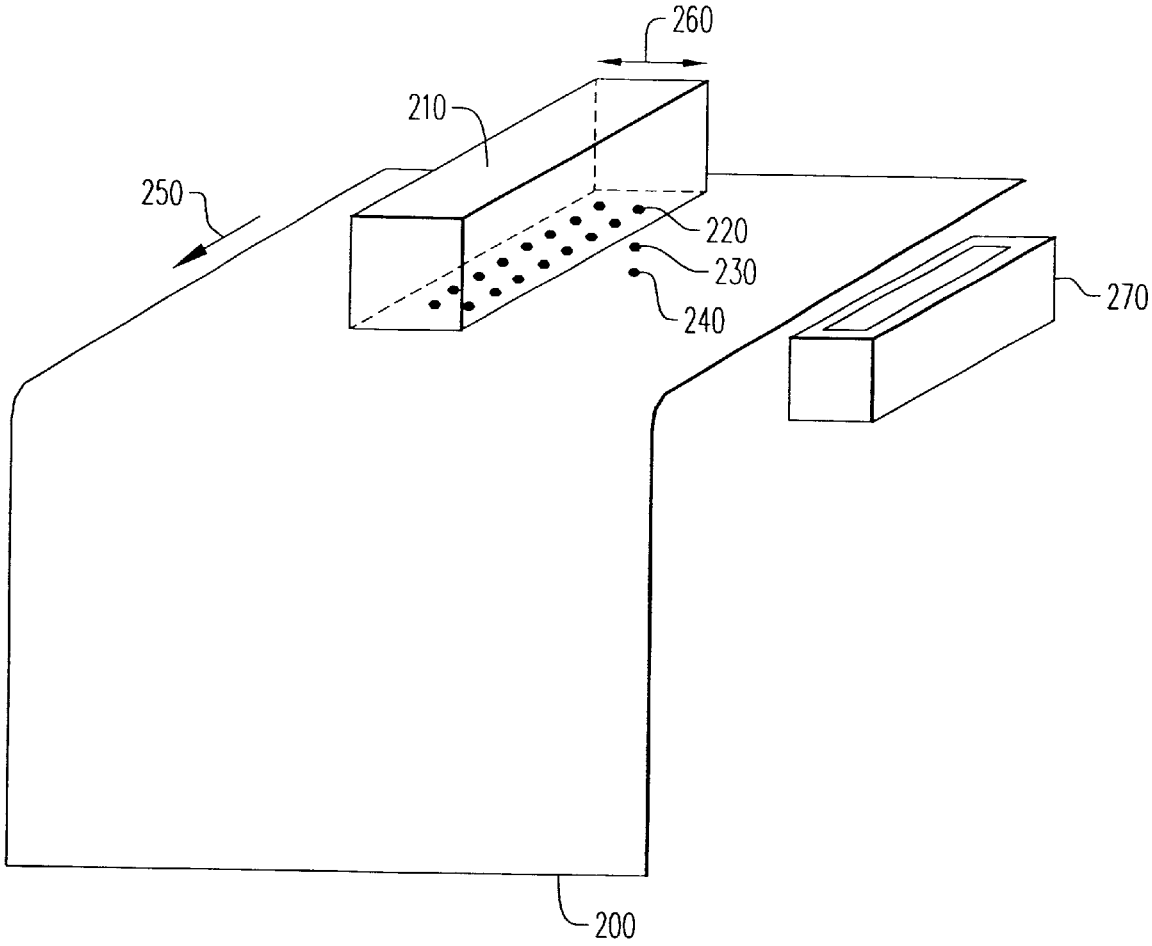
FIG. 2 (PRIOR ART)
FIG. 2 is a schematic representation of a conventional ink-jet printer device comprising an array of printer nozzles arranged into a plurality of parallel row.
Figure 3:
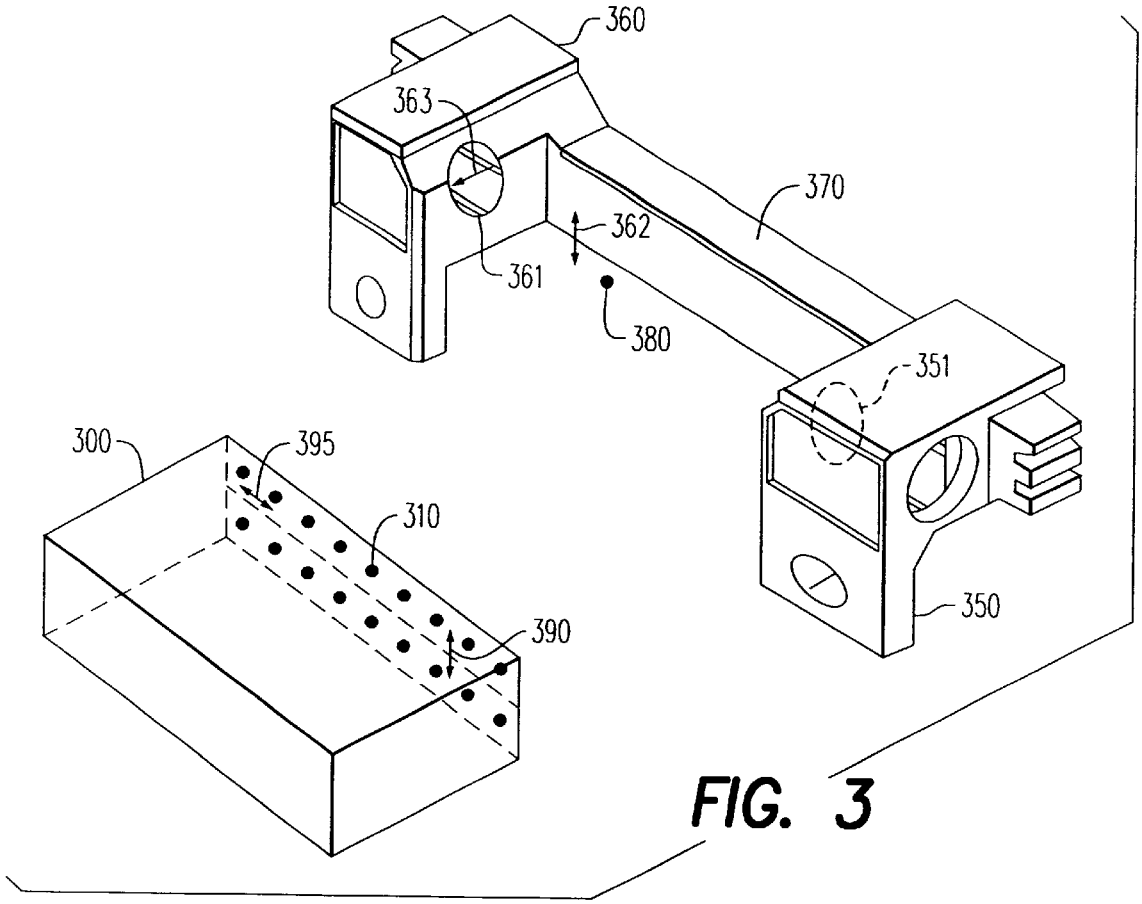
FIG. 3 illustrates schematically a printer head and detection device assembly according to a specific implementation of the present invention.

Referring to FIG. 3 herein, there is illustrated schematically a printer head and improved drop detection device according to a specific implementation of the present invention. A printer head 300 comprises an assembly of a plurality of printer nozzles 310. The printer head, in use, operates to eject a plurality of streams of ink drops which travel towards a print medium in a direction transverse to a main plane of the print medium, which typically comprises paper sheets, and in a direction transverse to a direction of travel of the print medium. Preferably the printer head 300 comprises two substantially parallel rows of printer nozzles 310, each row containing 262 printer nozzles. According to a specific method of the present invention, the printer nozzles in a first row are designated by odd numbers and the printer nozzles in a second row are designated by even numbers. Preferably a distance 390 between corresponding nozzles of the first and second rows is of the order 4 millimeters and a distance between adjacent printer nozzles 395 within a same row is $\frac{2}{600}$ inches (0.085 millimeters). Corresponding nozzles between first and second rows are off set by a distance of $\frac{1}{600}$ inches (0.042 millimeters) thereby yielding a printed resolution of 600 dots per inch (approx. 236 dots per cm) on the printed page.

The printer head 300 is configured, to spray or eject a single droplet of ink 380 from a single nozzle of the plurality of nozzles upon receiving a single drop release instruction signal.

When installed in a mass produced operational printer device, the printer head undergoes a test routine, for example when the printer device is first switched on, in order to check whether the printer head is operating correctly, and to check individual nozzles to see if any nozzles are malfunctioning or are anomalous. Anomalous nozzles may include nozzles which eject ink drops of a lower than average volume, nozzles which eject ink drops of a larger than average volume, nozzles which misfire, nozzles which malfunction by operating only intermittently, and nozzles which are misdirected.

Each nozzle 310 of the plurality of nozzles comprising printer head 300 are, according to the best mode presented herein, configurable to release a sequence of ink droplets in response to an instruction from the printer device. In addition to the printer head 300, there is also included an ink droplet detection means comprising a housing 360 containing an high intensity infra-red light emitting diode; a detector housing 350 containing a photo diode detector and an elongated, substantially rigid member 370. The emitter housing 360, rigid member 370 and detector housing 350 comprise rigid locating means configured to actively locate the high intensity infra-red light emitting diode with respect to the photo diode detector.

The printer head 300 and the rigid locating means 360, 370 and 350 are orientated with respect to each other such that a path traced by an ink droplet 380 ejected from a nozzle of the plurality of nozzles comprising the printer head 300 passes between emitter housing 360 and detector housing 350.

The high intensity infra-red light emitting diode contained within emitter housing 360 is encapsulated within a transparent plastics material casing. The transparent plastics material casing is configured so as to collimate the light emitted by the light emitting diode into a light beam. According to the best mode described herein, the collimated light beam emitted by the high intensity infra-red LED contained within emitter housing 360 exits the emitter housing via a first aperture 361. The collimated light beam from emitter housing 360 is admitted into detector housing 350 by way of second aperture 351. The light beam admitted into detector housing 350 illuminates the photo diode detector contained within detector housing 350. An ink droplet 380 ejected from a nozzle 310 on entering the collimated light beam extending between apertures 361 and 351 temporarily obstructs the infra-red light beam and causes a decrease in the amount of light entering aperture 351 and hence illuminating the photo diode contained within detector housing 350. Ink droplets are only detected if they pass through an effective detection zone in the collimated light beam which has a narrower width than a width of the collimated light beam. Preferably, the width of the effective detection zone 362 is approximately 2 millimeters. A width 363 of the emitter housing aperture 361 is preferably of the order 1.7 millimeters and similarly a width of the detector housing aperture 351 is preferably of the order 1.7 millimeters. Preferably, a distance from center of the effective detection zone and the rows of nozzles is of the order 3.65 millimeters.

Figure 4:
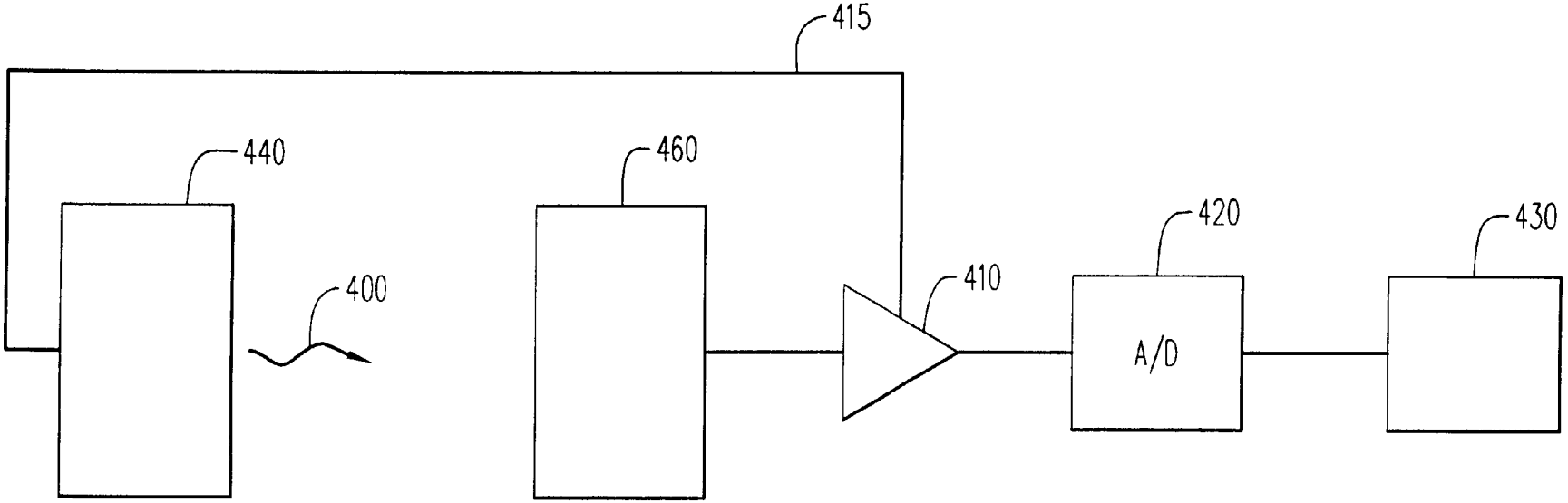
FIG. 4 illustrates schematically a functional overview of components of the drop detection device according to the specific implementation of the present invention.

Referring to FIG. 4 herein there is illustrated schematically functional blocks comprising the improved drop detection device according to the best mode presented herein. High intensity infra-red LED 440 emits a collimated light beam light 400 which is detected by photo diode detector 460. An output current of the photo diode detector 460 is amplified by amplifier 410. Additionally, amplifier 410 is configured to increase a driver current to high intensity infra-red LED 440 in response to a decrease in an output current of the photo diode detector 460 and to decrease an input current into high intensity infra-red LED 440 in response to an increase in the output current of photo diode detector 460 via signal path 415 thereby regulating the intensity of the light beam 400 with the object of achieving a substantially constant intensity beam. An amplified output current of amplifier 410 is input into an analogue to digital (A/D) converter 420. The A/D converter 420 samples the amplified output current signal of the photo diode. Preferably, the A/D converter 420 samples the amplified output current with a sampling frequency of 40 kilohertz. When a drop or series of drops, which in the best mode comprise either 2 or 4 drops per nozzle in a test routine, traverses the light beam 400, a perturbation pulse is caused in the output signal of detector 410. The A/D converted pulse is sampled by drop detection unit 430. Drop detection unit 430 processes a sampled output current of the photo diode detector 460 to determine whether or not an ink droplet has crossed the collimated light beam between the high intensity infra-red LED 440 and the photo diode detector 460. Additionally, analysis of the output current of the photo diode detector 460 enables operating characteristics of the printer nozzles to be determined. The time period between samples is, preferably in the order 25 $\mu$s hence yielding a total sampling time of 1.6 milliseconds. The 64 samples of the output of the photo diode 460 are stored within a memory device which may be a random access memory device in drop detection unit 430. Drop detection unit 430 may also be configured to store in a memory device an indication of whether or not a nozzle of the plurality of nozzles comprising printer head 300 is functioning correctly or not.

According to the best mode presented herein, before printing a page on the print medium the printer device checks the nozzles comprising printer head 300 by performing a sequence of test operations for the purpose of determining the operating performance of each nozzle and the print head as a whole, which are known hereinafter as drop detection. Each nozzle within a row of nozzles in turn sprays a predetermined sequence of ink droplets such that only one nozzle is spraying ink droplets at any time. Each nozzle within the plurality of nozzles comprising the printer head is uniquely identified by a corresponding respective number. Preferably, a first row of nozzles are identified by a contiguous series of odd numbers between 1 and 523 and a second row of nozzles are identified by a contiguous series of even numbers between 2 and 524. During drop detection each odd numbered nozzle within a row is operated to spray a predetermined sequence of ink droplets. Then printer head 400 is moved to bring the second row of nozzles into line with the center of the light beam, and each nozzle of the second row sects a predetermined sequence of ink droplets. For each predetermined sequence of ink droplets ejected from each nozzle, a corresponding respective perturbation signal is produced in the detector output signal, as the predetermined sequence of droplets travels through the light beam. In the best mode herein, the width of the light beam, the distance between the center of the light beam and the rows of nozzles are arranged such that the sequence of droplets which are ejected from the printer nozzle, typically at a velocity in the order of 16 meters per second, are slowed down by air-resistance, such that when the first ink droplet of a predetermined sequence reaches a far side from the nozzle of the light beam, the subsequently ejected ink droplets of the predetermined sequence following the first droplet of the sequence have also traveled to be within the cross-section of the light beam, such that transiently, all ink droplets of the predetermined sequence ejected from a nozzle are within the cross-section of the light beam at a same time, and result in a single perturbation pulse per each determined ejected sequence. The distances between the center of the light beam and the nozzles and the velocity of ejection of the ink droplets from the nozzles are arranged such that there is 'bunching up' of the ink droplets spatially, due to air resistance, such that at a distance (in the best mode herein approximately 3.65 millimeters) from the nozzles, corresponding with the center of the light beam, the ink droplets are transiently all within the light beam at the same time.

Figure 5:
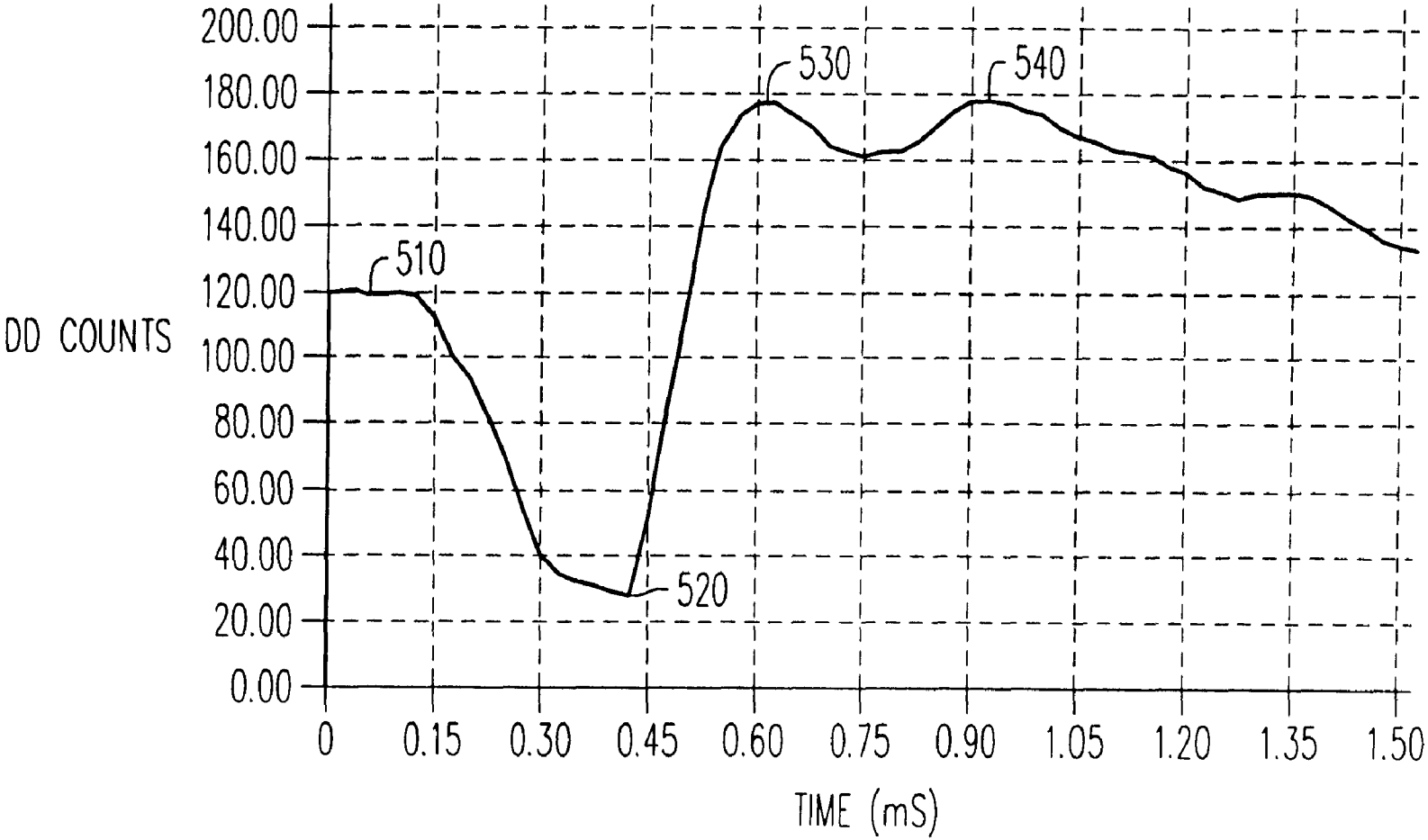
FIG. 5 illustrates graphically, by way of example, an output signal of the drop detection device according to the specific implementation of the present invention.

Referring to FIG. 5 herein, there is illustrated graphically, by way of example, a sampled output signal of photo diode detector 460 illustrated by the continuous solid line 510 and produced in response to a sequence of droplets ejected from a single nozzle 310 and entering the collimated light beam emitted by high intensity infrared LED 440. On a vertical axis of FIG. 5, there is represented a quantization of the current amplitude of the output signal from detector 410, which corresponds to an intensity of infra-red light falling on the detector. On the horizontal axis of FIG. 5, there is represented time from an arbitrarily set zero time, prior to a perturbation pulse signal in the detector output current. At initial time 510, corresponding to a time when the light beam is unobstructed by passing ink droplets, the output current signal resides at a steady state value, which is maintained at a substantially constant level by virtue of the feedback mechanism operated by amplifier 410 which regulates the detector output signal, by increasing or decreasing the drive signal to the LED 440. As a predetermined sequence of ink droplets passes through the light beam between the emitter and detector, the intensity of light falling on the detector is reduced temporarily until a minimum intensity (in FIG. 5 in the order of 30 quantization units) is reached at a time 520. In response to a decrease in the output current of the photodiode detector 460, due to a detected sequence of ink droplets traversing the light beam, an increased driver current to the high intensity infrared LED 440 supplied by amplifier 410 increases the intensity of the collimated light beam thereby increasing the output current of photodiode detector 460. At third time 530, which occurs approximately 0.15 milliseconds after the minimum intensity point at time 520, the output signal of the amplifier 410 reaches a maximum, which in the example of FIG. 5, is approximately 60–70% greater than the steady state current value at time 510. The gradient of signal response between second time 520 at minimum output current signal value and third time 530 at maximum output current value can be varied by design of the feedback characteristics of the feedback loop comprising amplifier 410, emitter 440 and detector 460. The response time (the difference between second time 520 and third time 530) the gradient of rise on the current output after minimum intensity, and oscillation period between third time 530 and fourth time 540 at which a second peak response occurs are all capable of variation and design by variation of the inherent frequency response characteristics of the feedback loop as will be understood by those skilled in the art.

According to the best mode presented herein, a number of ink droplets within the predetermined sequence of ink droplets is configured such that a total volume of ink simultaneously occulting the collimated light beam emitted by high intensity infrared LED 440 lies substantially within the range –100 picolitres, and more preferably within a range of 30–100 picolitres. A total ink droplet volume of 30–100 picolitres provides a sufficient disturbance of the light input into photodiode detector 460 to ensure an output signal, in response to the presence of a predetermined sequence of ink droplets, having a substantially larger amplitude than a typical noise amplitude introduced by, for example, amplifier 410.

Figure 6:
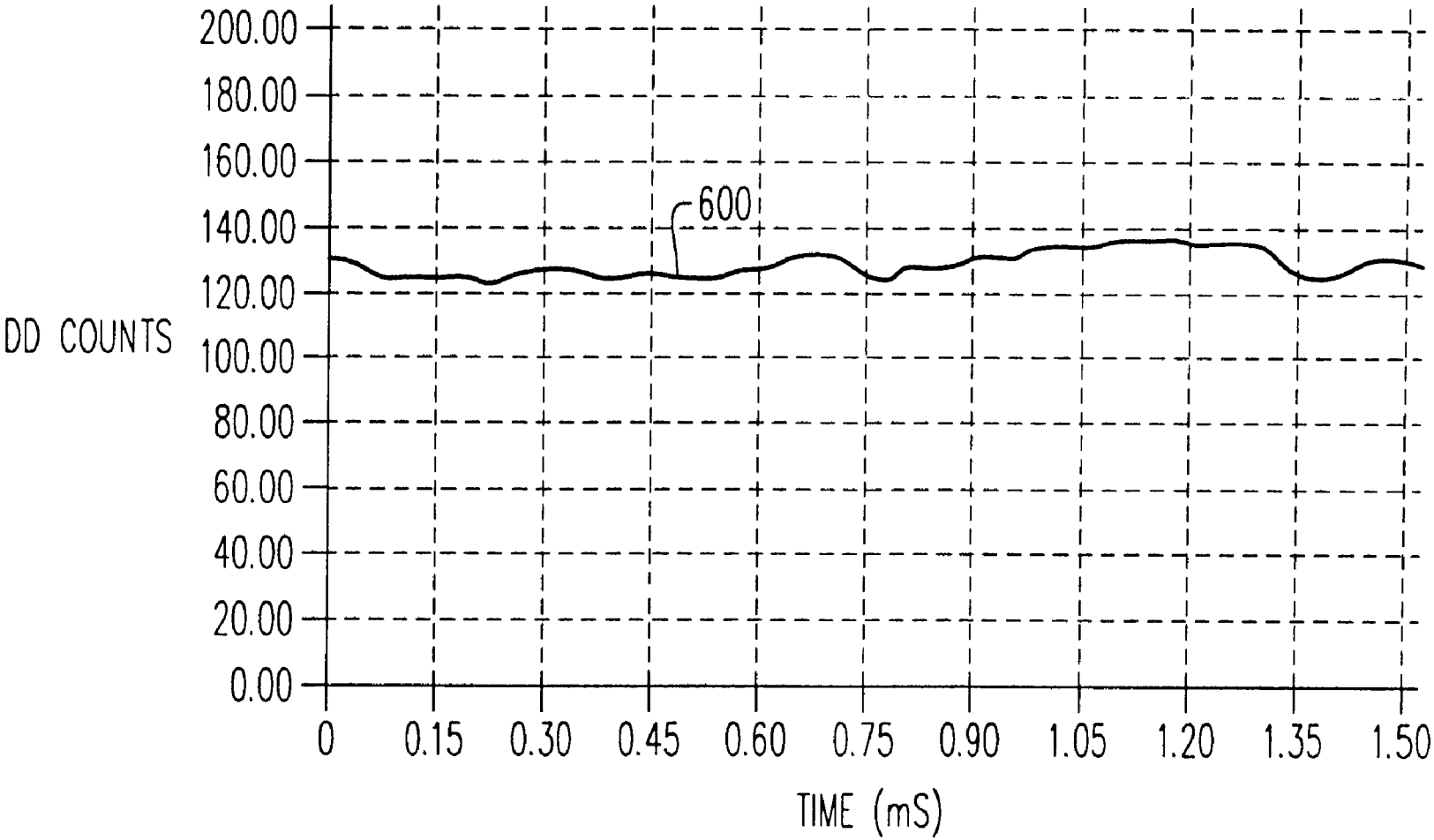
FIG. 6 illustrates graphically, by way of example, an output signal of the drop detection device in the case where an ink droplet has not been detected.

Referring to FIG. 6 herein, there is illustrated graphically, by way of example, an output signal 600 of A/D converter 420 in a case where an instruction to eject a predetermined sequence of ink droplets from a nozzle 310 has been sent to the printer head 300 but no ink droplets have entered the collimated light beam emitted by LED 440. A nozzle 310 might be prevented from ejecting ink droplets if, for example, the nozzle is clogged with an accumulation of ink or blocked with a paper fiber. The response of FIG. 6 is for a wholly malfunctioning nozzle. The quantized amplitude of amplifier 410 fluctuates by around 10–15% of its value.

Figure 7:
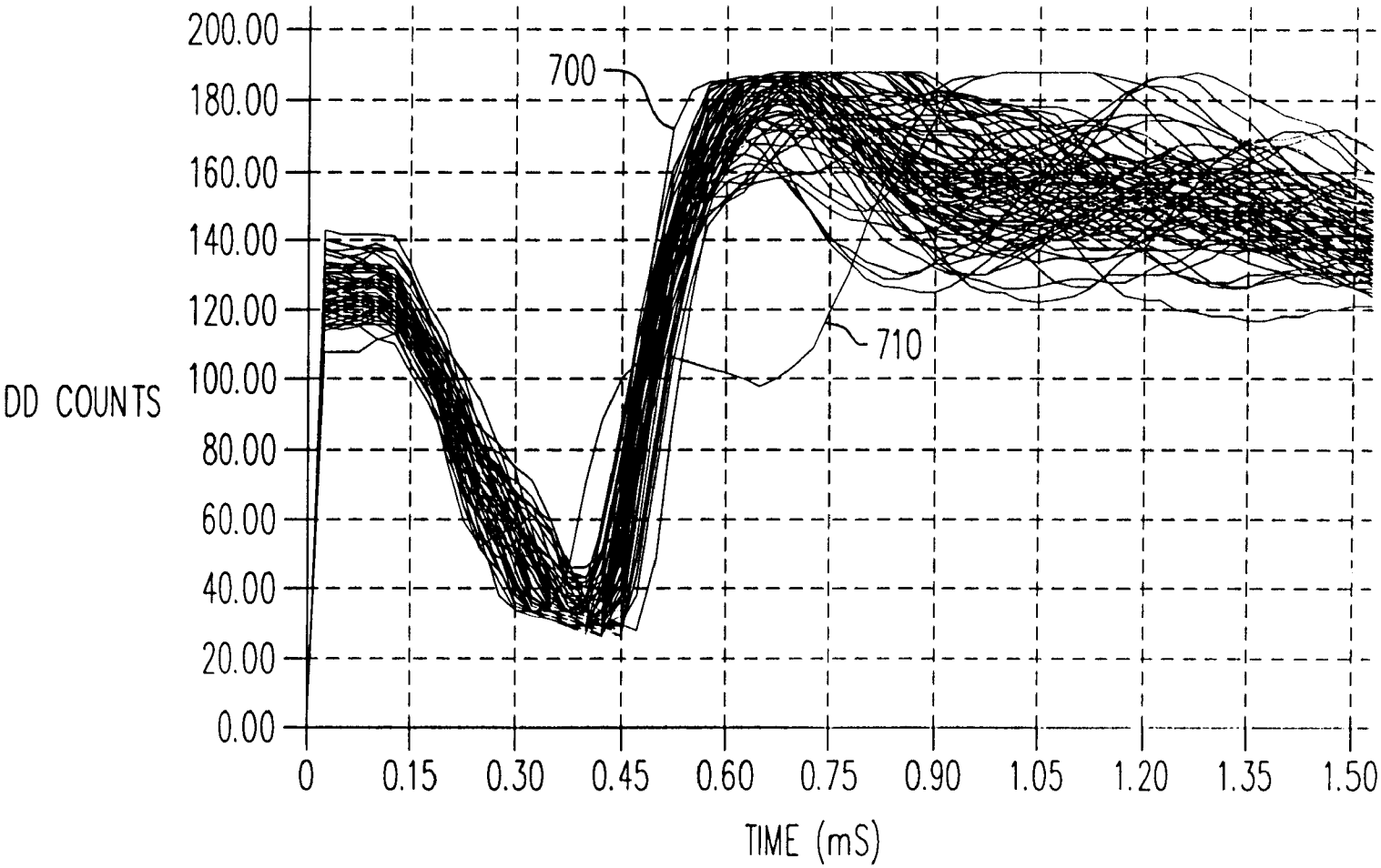
FIG. 7 illustrates graphically, by way of example, a plurality of output signals from a drop detection device, the output signals having being produced by a plurality of nozzles of a printer head and includes an output signal from a misfiring nozzle.

Referring to FIG. 7 herein, there is illustrated graphically, by way of example, a plurality of sampled outputs 700 of photodiode detector 460 produced in response to a plurality of correctly firing nozzles from a same row of a printer head 300. The individual data concerning the passage of ink droplets through the collimated light beam for each nozzle afforded by the high frequency (40 kilo hertz) sampling of the photodiode detector 460 output current reveals that in some instances the output signal generated by a predetermined sequence of ink droplets fired from a particular nozzle differs significantly from the signals produced by ink droplets fired from adjacent nozzles in a same row of the printer head 300. Output signal 710 is an example of a significantly different output signal. Nozzles which produce corresponding sampled output signals which differ significantly from the output signals of adjacent nozzles are termed herein as anomalous or aberrant nozzles. According to the best mode presented herein, detection of the presence or absence of ink droplets being ejected from a nozzle may be determined by subtracting a minimum output signal from a maximum output signal of each signal response resulting from each predetermined sequence of ink droplets to obtain a corresponding respective peak-to-peak signal. However, referring to FIG. 7 it can be seen that an anomalous nozzle may escape detection on the basis of a simple peak-to-peak calculation. Hence, it is one aspect of the present invention to use the improved knowledge concerning ink droplets crossing the collimated light beam emitted by the high intensity infra-red LED 440 to identify incorrectly functioning nozzles (which are also known herein as anomalous nozzles) which may escape detection using previous prior art drop detection techniques.

Figure 8:
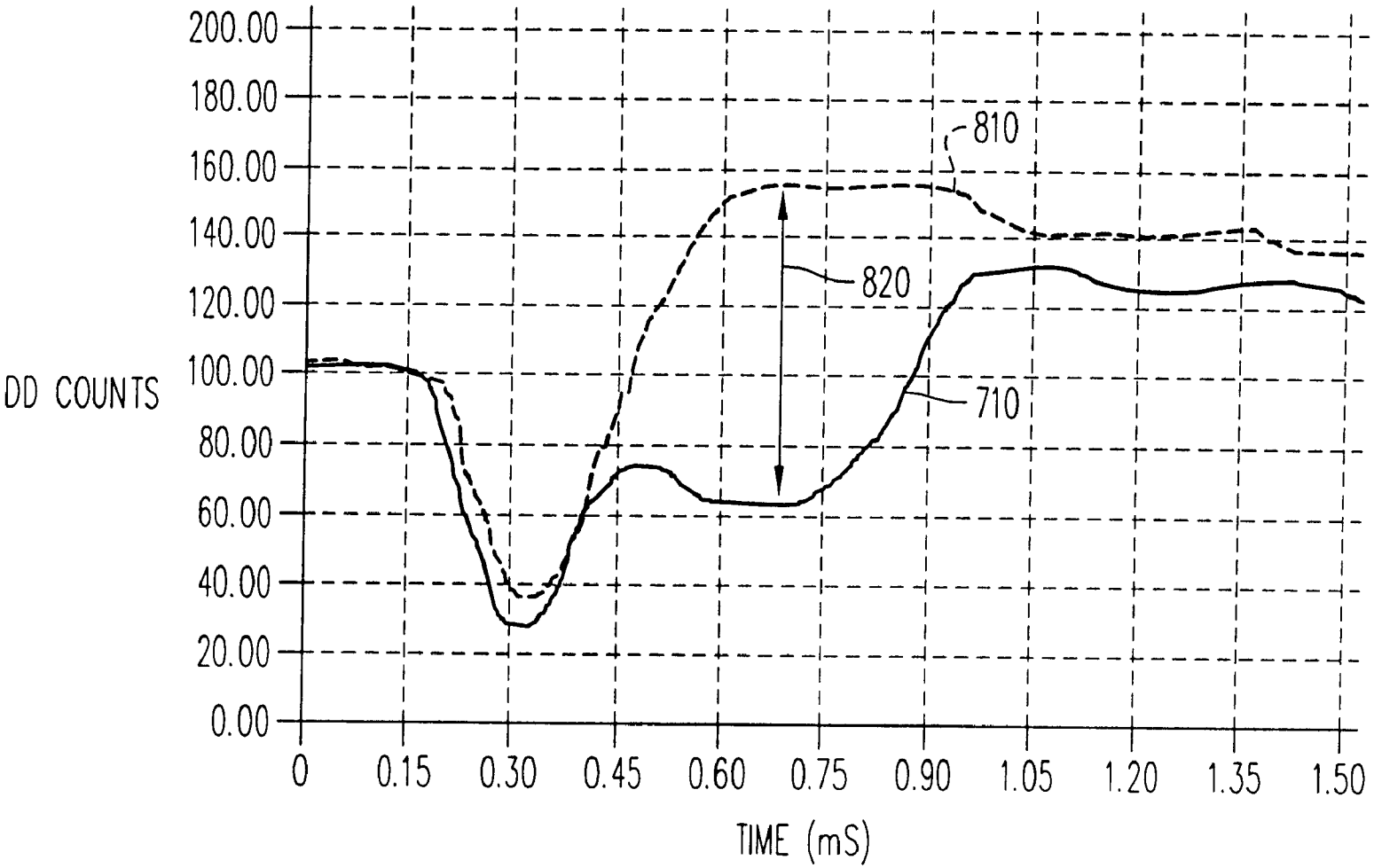
FIG. 8 illustrates graphically, by way of example, a comparison between an output signal of the drop detection device for both an average output signal determined from a plurality of correctly firing nozzles and an output signal from a misfiring nozzle.

Referring to FIG. 8 herein, there is illustrated graphically, by way of example, a preferred method by which an anomalous nozzle is detected. An output signal 710 corresponding to a nozzle which is to be tested is compared to an average output signal 810 calculated by averaging a plurality of corresponding signal responses from a plurality of nozzles substantially adjacent to and in a same row as the nozzle to be tested. A total error signal is generated by combining an amplitude difference value 820 between corresponding samples of the average output signal 810 and an output signal 710 corresponding to the nozzle to be tested.

Figure 9:
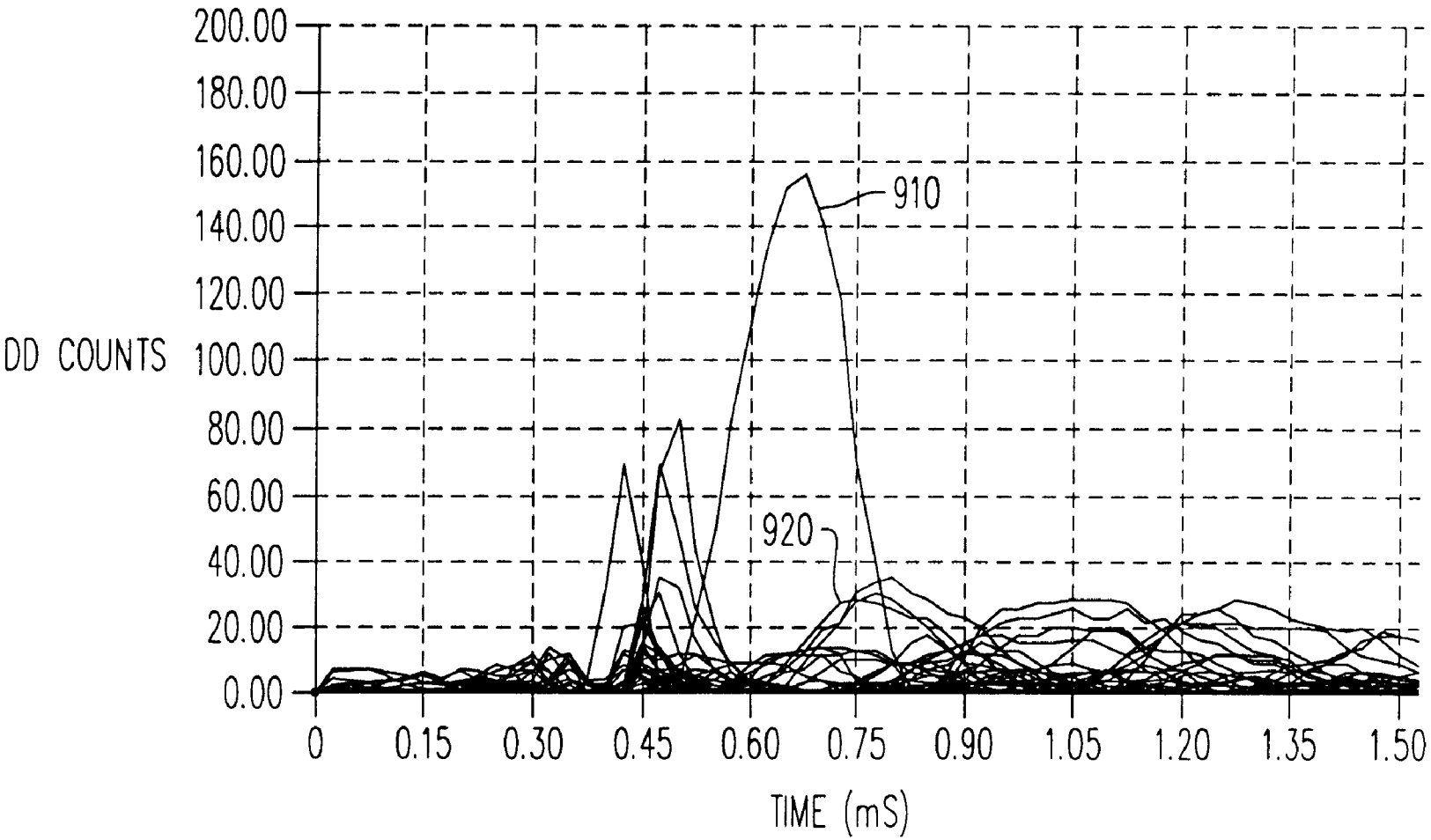
FIG. 9 illustrates graphically, by way of example, an error signal derived for an anomalous nozzle compared to a plurality of error signals originating from correctly functioning nozzles according to a first specific method of the present invention.

Referring to FIG. 9 herein, there is illustrated graphically, a comparison of differences between corresponding samples of a plurality of correctly functioning nozzles 920 in relation to an average response and an anomalous nozzle 910 in relation to an average response. The vertical axis in FIG. 9 corresponds to a difference between the quantized sampled amplitude of output current response from detector 410 for a single anomalous nozzle, and an average of the quantized output signal responsive from detector 410 for each of a plurality of nozzles, 810 in FIG. 8. Curve 910 in FIG. 9 represents a difference in signal response for a signal produced by a single nozzle, relative to an average signal determined from the plurality of other nozzles. Comparison of the total error for an anomalous nozzle compared with the corresponding total errors of correctly functioning nozzles enables, according to the best node presented herein, anomalous nozzles to be readily detected.

Figure 10:
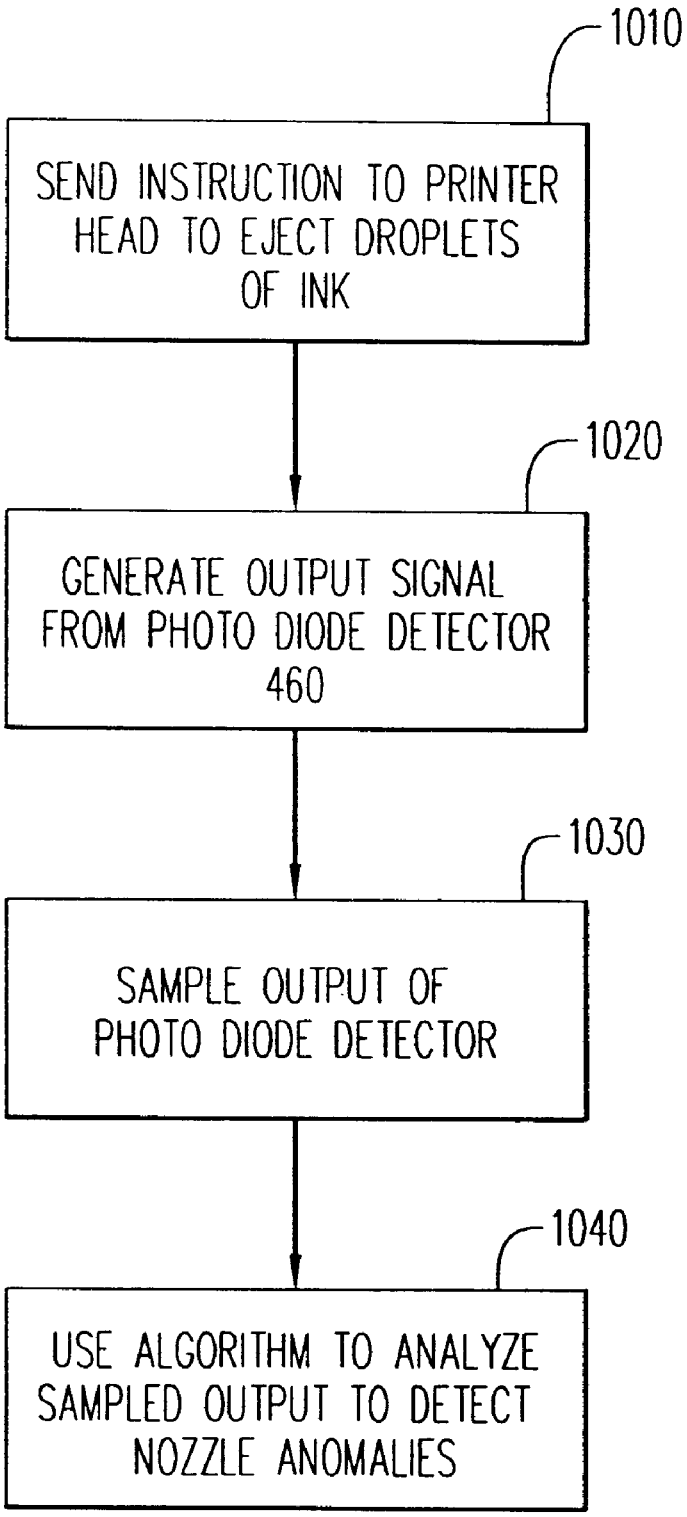
FIG. 10 illustrates schematically steps involved in detecting anomalous nozzles according to the first specific method of the present invention.

Referring to FIG. 10 herein, there is illustrated schematically, steps involved in detecting anomalous nozzles according to the best mode presented herein. The steps in FIG. 10 are repeated for each of the nozzles in the print head. In step 1010, an instruction is sent to the printer head 300 to eject a predetermined sequence of droplets of ink. Preferably, each nozzle forming a first row of the printer head fires the predetermined sequence of droplets such that only one nozzle is ejecting droplets at any moment. If, in response to the instruction in step 1010, ink droplets are ejected from a nozzle, then as the ink droplets enter the collimated light beam emitted by high intensity infrared LED 440 the light input into the photodiode detector 460 decreases as the light beam is occulted by the ink droplets. In step 1030, after a time delay of 0.2 milliseconds from the time at which the instruction was sent in step 1010, the time delay also being known herein as "fly time", the A/D converter 420 commences sampling the amplified output signal of photodiode detector 460 amplified by amplifier 410. Preferably the AID converter 420 samples the amplified output signal of the photodiode detector at a rate of 40 kilohertz. Preferably, the A/D converter samples the output signal, which may be an output voltage signal or an output current signal, the total of 64 times. Each sample represents the amplitude of the output signal as an 8 bit binary number. The number representing an amplitude of the output signal is also known herein as drop detect (DD) counts. The 64 8-bit samples of the amplitude of the output signal of photodiode detector 460 and amplifier 410 corresponding to a predetermined sequence of ink droplets fired from one nozzle are stored in a memory location of a memory device. The memory device may be a random access memory (RAM) device.

In step 1040, a microprocessor having random access memory and read only memory (ROM) applies an algorithm to compare the sampled output signal resulting from ink droplets ejected from a selected nozzle with corresponding sampled output signals resulting from ink droplets ejected from adjacent nozzles of the printer head. The algorithm derives a total error signal for each nozzle for comparison with a total error signal determined from each other nozzle of the plurality of nozzles comprising the printer head in order to determine operating characteristics of each nozzle and thereby identify anomalous nozzles.

Figure 11:
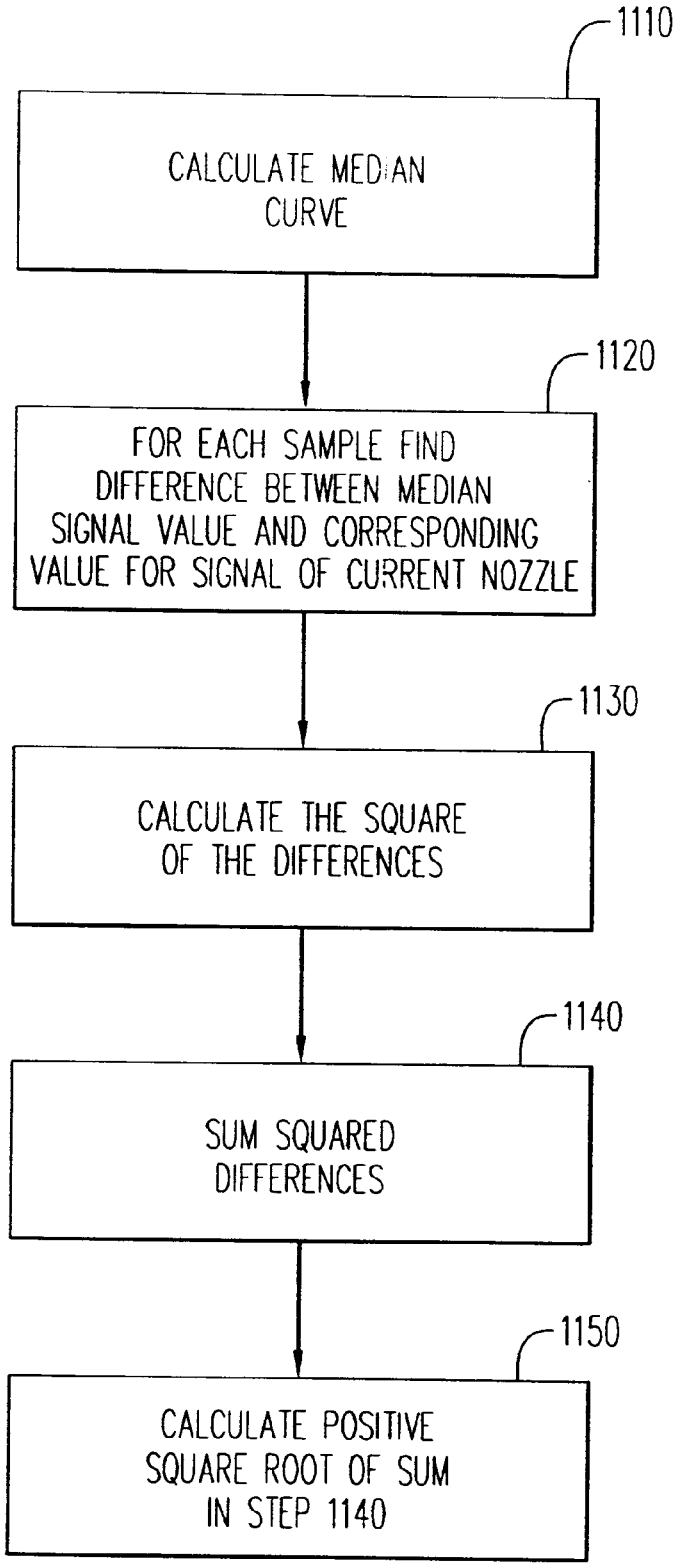
FIG. 11 illustrates schematically a first algorithm used for detecting anomalous nozzles according to the first specific method of the present invention.

Referring to FIG. 11 herein, there is illustrated schematically an algorithm used to calculate the total error signal according to a preferred embodiment of the present invention. Each nozzle of the plurality of nozzles is tested by comparison with an average drop detect output signal 810. The average output signal 810 is calculated by averaging the output signals of a plurality of the nozzles in a same row as the nozzle to be tested and which lie substantially adjacent to the nozzle to be tested. Preferably, the average output signal curve is calculated by averaging corresponding respective samples stored in a memory device of the drop detection output signals generated by the twenty nearest nozzles located on either side of the nozzle being tested and in the same row as the nozzle being tested. By way of example, considering the case where a nozzle number 50 is currently being tested, an average drop detection output signal of amplifier 410 is calculated by averaging a plurality of output signals generated by ink droplets ejected from all even numbered nozzles having identifying numbers between 10 and 48 and between 52 and 90.

In the case where a nozzle to be tested lies less than twenty nozzles away from either end of the row of nozzles in the printer head, the selection of nozzles used to calculate an average drop detection output signal is as follows:

The total number of nozzles used to calculate the average signal remains constant. If, for example, the current nozzle being tested has a nozzle number 10, then the average signal is calculated using the corresponding output signals relating to nozzles 2, 4, 6, 8 and 12, 14 . . . 78, 80.

Preferably, according to the best mode presented herein, the average output signal is a median value of the corresponding output signals of the nozzles adjacent to the nozzle being tested. The median is chosen in order to minimize the effects of the outputs of other anomalous nozzles on the calculated values of the average output signal 810. The median signal is determined from the plurality of selected output signals corresponding to the respective selected nozzles as follows. For each signal response of the plurality of signal responses, a first sample is taken after a first time period from a start time of the sample. A median is taken of the plurality of digitized amplitudes of all of the plurality of sampled signals, at the first time period after the initial start time of the sampling period. The result is a single value representing a median value of all the plurality of signals, at the first sample interval. Similarly, at the second sample interval, a median value of all digitized quantized amplitude values of all of the plurality of nozzles used as the basis for the median curve is taken to provide a single median value at the second sample interval after the start of the sampling period. Similarly, for third, fourth and successive sample intervals up to the maximum $64^{th}$ sample interval after the start of the time period. The first value of the median output signal is calculated by taking a median value of corresponding first sampled values of the adjacent nozzles as described herein before. Similarly, a second median output signal value is calculated by taking the median value of corresponding second values of the output signals relating to the adjacent nozzles as described herein before.

In step 1120, a difference is calculated between a sampled value of the output signal of the drop detection and a corresponding median value calculated in step 1110. As described earlier, the amplified output signal of the photodiode detector 460 is sampled 64 times by A/D converter 420. Hence, in step 1120 there are calculated 64 different signal values between the median output signal and the output signal corresponding to the current nozzle being tested. In step 1130, each of the difference signals calculated in step 1120 are squared and in step 1140 a sum of the squared differences is calculated. In step 1150, a positive square root of the summed, squared differences between the median output signal and the output signal corresponding to the current nozzle being tested is calculated. A total error calculated in step 1150 gives a measure of the whole of the difference between an output signal generated by a given nozzle in comparison with the median output signal determined from the plurality of output signals resulting from the plurality of adjacent nozzles.

Figure 12:
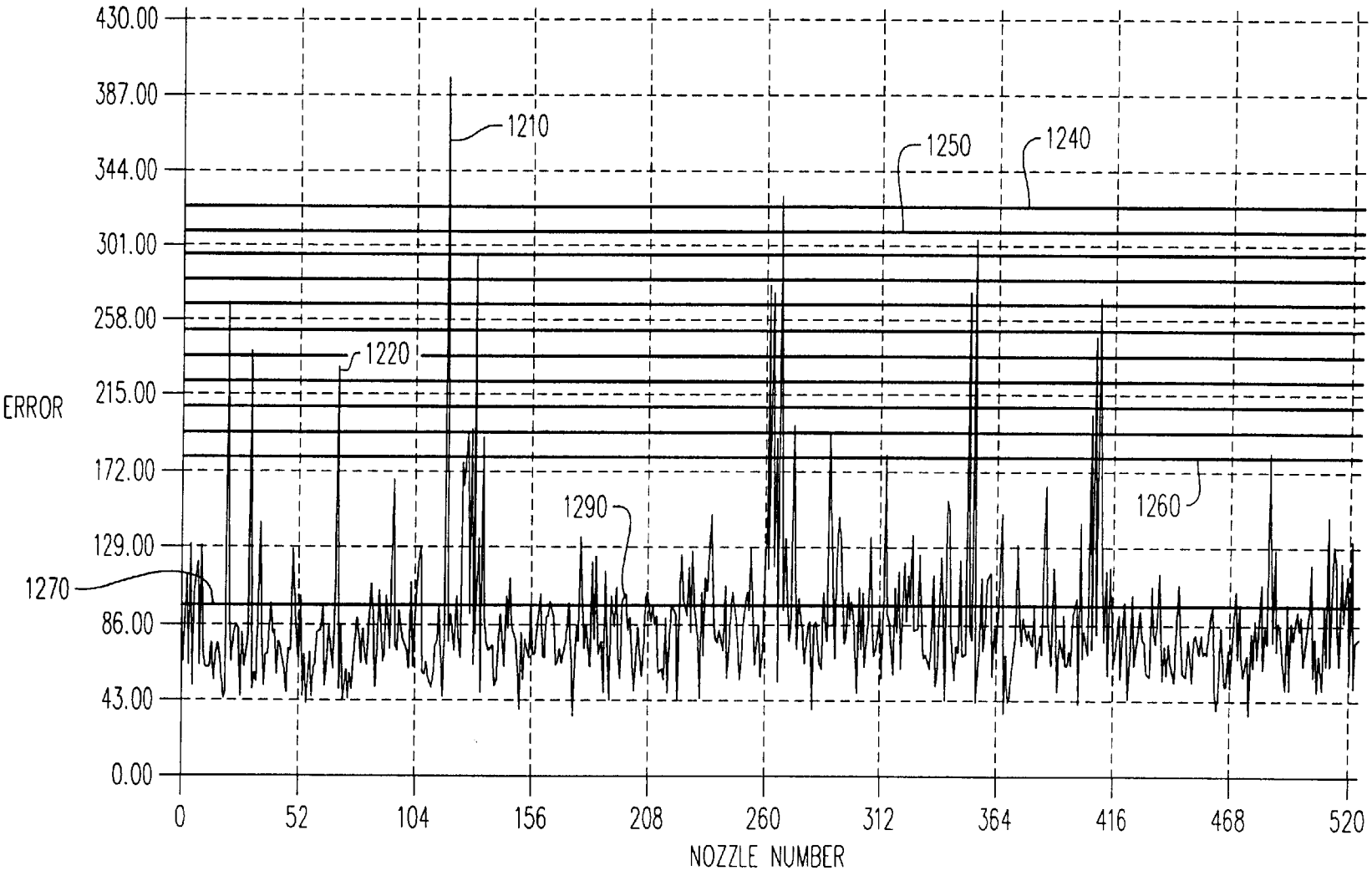
FIG. 12 illustrates graphically, by way of example, a plot of errors calculated according to the first specific method of the present invention for a printer head comprising 524 nozzles.

Referring to FIG. 12 herein, there is illustrated graphically, by way of example, a plot of error value calculated for each nozzle as a function of nozzle number. Using the algorithm as described earlier, a total integrated error is calculated for each nozzle of the plurality of nozzles comprising the printer head. According to the best mode described herein, a median error 1270 is calculated from the total integrated errors calculated for each nozzle 1210, 1220, 1230. The median error is calculated by sorting the plurality of total integrated errors in order of increasing size into an array and taking the mean, e.g. average, of the total integrated errors associated with element numbers 262 and 263 of the array of sorted total integrated errors in the case of a printer head comprising 524 nozzles. Additionally, an upper quartile error value is calculated by forming a mean of the total integrated errors associated with element numbers 393 and 394 of the array of sorted to total integrated errors, for the case of the printer head comprising 524 nozzles.

Having calculated a median error value from the plurality of total integrated errors derived from the plurality of nozzles, and having calculated the corresponding upper quartile error value, for any nozzle, the probability of measuring a total integrated error at a particular value above the median error value can be calculated. The number characterizing the probability (known herein as sigma) is calculated using the following equation:

$$\text{Sigma}=\text{abs}(\text{upper quartile}-\text{median})/1.35.$$

Sigma is the absolute value of the difference between the upper quartile error value and the median error value calculated as described herein before, wherein the difference between the two upper quartile error value and median error value is divided by 1.35.

In FIG. 12 the black horizontal lines including 1240, 1250 and 1260 represent multiples of the sigma value calculated herein before. Line 1260 represents 7× the calculated sigma value. For comparison there are also plotted on FIG. 12 a line representing 8× sigma, 9× sigma . . . 16× sigma 1250 and 17× sigma represented by line 1240. It can be seen from FIG. 12 that certain of the total integrated error values corresponding to individual nozzles of the plurality of nozzles comprising the printer head have significantly larger error values than the majority of the errors calculated for other nozzles 1230. For example, error value 1220 is more than 10 sigma greater than the median error value calculated from the total integrated error values corresponding to the same plurality of nozzles. Similarly, error 1210 is more than 17 sigma greater than the calculated median error value.

It is one aspect of the present invention to identify anomalous nozzles by defining an anomalous nozzle as a nozzle which has a total integrated error which is greater than a predetermined number of sigma as described herein before. Preferably, the predetermined sigma level is 10 sigmas. Referring to Table 1 there is summarized how the average probability of failing a correctly functioning, non-anomalous nozzle decreases as the number of sigmas used to identify anomalous nozzles is increased. Table 1 is obtained using the algorithm according to a preferred embodiment of the present invention to calculate the total integrated error values.

TABLE 1

| Number of sigmas | Average probability of failing a good nozzle |
|---|---|
| 7 | 1.60% |
| 9 | 0.69% |
| 11 | 0.31% |
| 13 | 0.14% |
| 15 | 0.08% |
| 17 | 0.04% |

Figure 13:
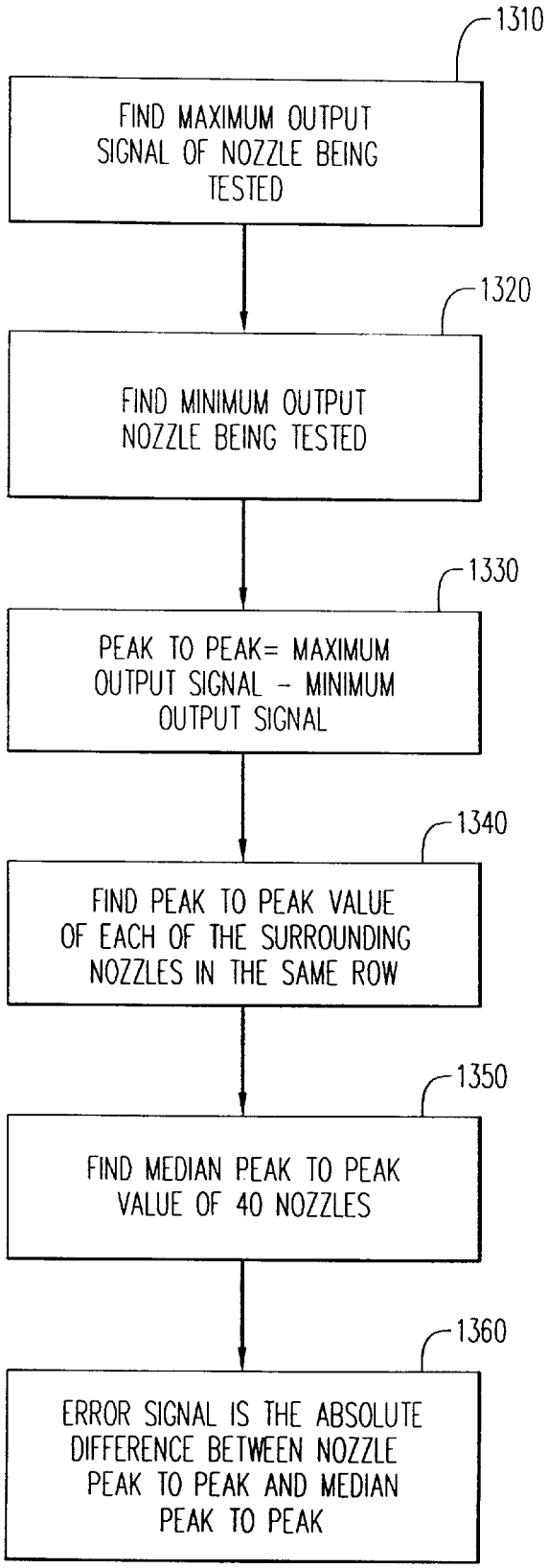
FIG. 13 illustrates schematically a second algorithm used for detecting anomalous nozzles according to a second specific method of the present invention.

Referring to FIG. 13 herein, there is illustrated schematically an algorithm used to calculate a total error signal according to a second embodiment of the present invention. In step 1310, the largest sampled output value of the 64 samples of each respective nozzle is identified. Similarly, in step 1320, a minimum sampled output value of the 64 sampled outputs of each respective nozzle is identified. In step 1330, a peak-to-peak value is calculated by subtracting a minimum sampled value obtained in step 1320 from the maximum sampled value obtained in step 1310. In step

1340, a peak-to-peak value is calculated for each nozzle of a plurality of nozzles in same row as the nozzle to be tested and which lies substantially adjacent to the nozzle to be tested. Preferably, the peak-to-peak values are calculated for the twenty nearest nozzles located on either side of the nozzle being tested and in the same row as the nozzle being tested. By way of example, considering the case where nozzle number 50 is currently being tested, the peak-to-peak values are calculated for output signals generated by ink droplets ejected from all even numbered nozzles having identifying numbers between 10 and 48 and between 52 and 90.

In a case where the nozzle to be tested lies less than twenty nozzles away from either end of the row of nozzles in the printer head, the selection of nozzles for which peak-to-peak values are calculated is as follows:

The total number of nozzles for which peak-to-peak values are calculated remains constant. If, for example, the current nozzle being tested has a nozzle number 10, then the peak-to-peak values are calculated using the corresponding output signals relating to nozzles 2, 4, 6, 8 and 12, 14 . . . 78, 80.

In step 1350, a median peak-to-peak value is calculated from peak-to-peak values of the surrounding nozzles in a same row as a nozzle being tested as identified in step 1340. In step 1360, a total integrated error signal is calculated by taking an absolute difference between a peak-to-peak output of a current nozzle being tested and a median peak-to-peak value calculated in step 1350.

Figure 14:
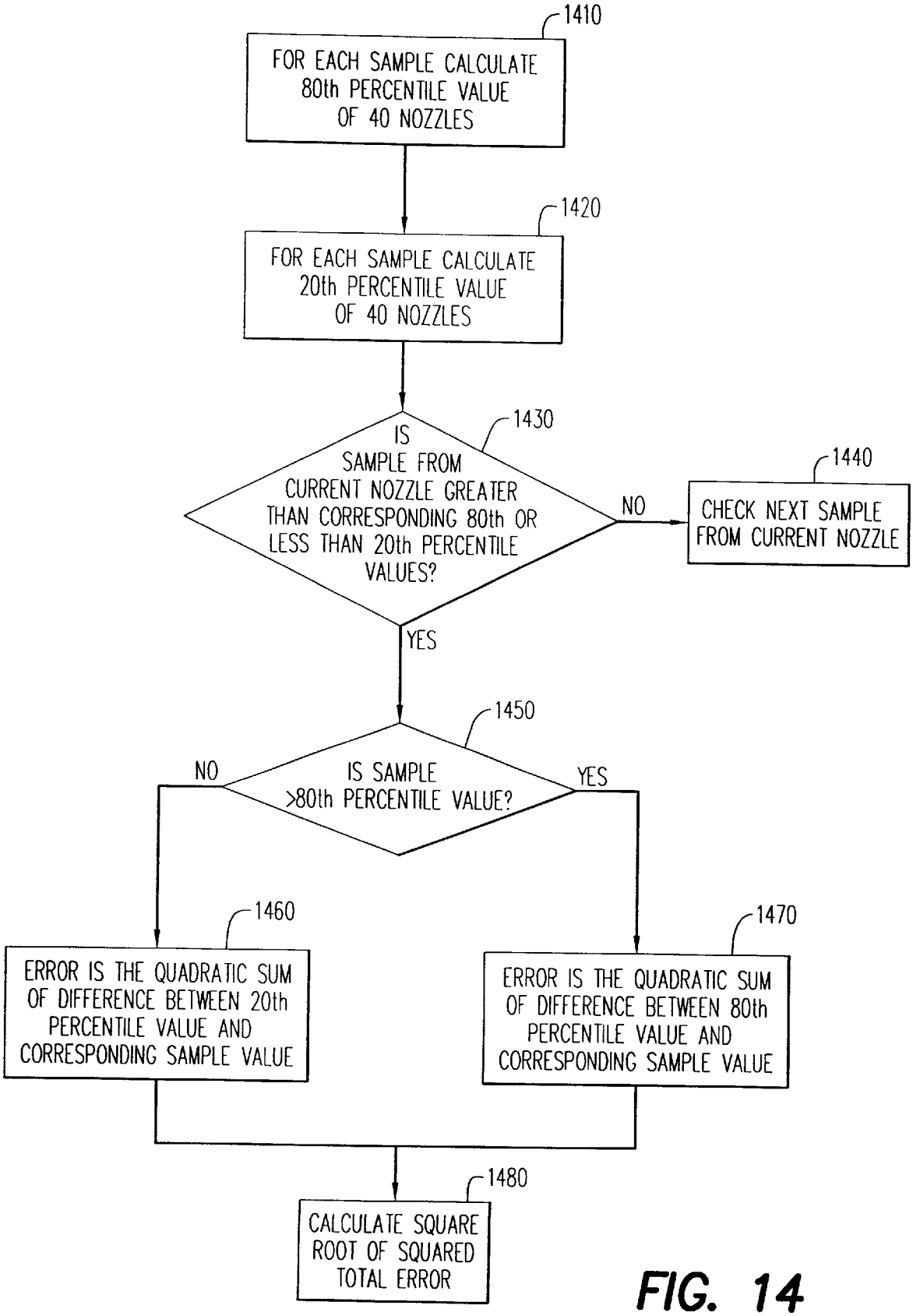
FIG. 14 illustrates schematically a third algorithm used for detecting anomalous nozzles according to a third specific method of the present invention.

Referring to FIG. 14, there is illustrated schematically a third algorithm used to calculate the total error signal according to a third embodiment of the present convention. Each nozzle of the plurality of nozzles comprising the printer head is tested by comparing its output signal with corresponding respective output signals of a plurality of nozzles in a same row as the nozzle to be tested and which lie substantially adjacent to the nozzle to be tested. Preferably, the output signal of the nozzle to be tested is compared with output signals generated by the twenty nearest nozzles located on either side of the nozzle to be tested and in the same row as the nozzle being tested. By way of example, considering the case wherein nozzle number 50 is currently being tested then it is compared with output signals generated by ink droplets ejected from all even numbered nozzles having identifying numbers between 10 and 48 and between 52 and 90. In a case where a nozzle to be tested lies less than twenty nozzles away from either end of a row nozzles in the printer head then the selection of nozzles used to compare with the nozzle being tested is as follows:

The total number of nozzles used to compare with the nozzle being tested remains constant. If, for example, the current nozzle being tested has a nozzle number 10, then the nozzles used to compare with the nozzle being tested are nozzles being identified by the numbers 2, 4, 6, 8 and 12, 14 . . . 78, 80.

In step 1410, for each nozzle of the 40 nozzles substantially adjacent to the current nozzle being tested, as described herein before, an $80^{th}$ percentile value is calculated from a first corresponding respective sample value of each of the adjacent nozzles, the $80^{th}$ percentile value being calculated by sorting the values into order of increasing size in an array and taking as the $80^{th}$ percentile value an element of the array whose value is denoted by:

$$N \times \frac{4}{5} + 0.5$$

Where N is the number of nozzles comprising the printer head. In a similar fashion, $80^{th}$ percentile values are worked out for each corresponding respective second sample of each of the 40 substantially adjacent nozzles as described herein before. And in a similar fashion, $80^{th}$ percentile values are calculated for the $3^{rd}$, $4^{th}$, . . . $63^{rd}$, $64^{th}$ corresponding respective samples of each of the substantially adjacent nozzles.

In step 1420, for each nozzle of the 40 nozzles substantially adjacent to the current nozzle being tested, as described herein before, a $20^{th}$ percentile value is calculated from a first corresponding respective sample value of each of the adjacent nozzles. The $20^{th}$ percentile value is calculated by sorting the values into order of increasing size in an array and taking as the $20^{th}$ percentile value an element of the array whose value is denoted by:

$$N \times \frac{1}{5} + 0.5$$

Where N is the number of nozzles comprising the printer head. In a similar fashion, $20^{th}$ percentile values are worked out for each corresponding respective second sample of each of the 40 substantially adjacent nozzles as described herein before. And in a similar fashion, 201 percentile values are calculated for the $3^{rd}$, $4^{th}$, . . . $63^{rd}$, $64^{th}$ corresponding respective samples of each of the substantially adjacent nozzles.

In step 1430, the first sampled value of the current nozzle being tested is compared with the $80^{th}$ percentile and the $20^{th}$ percentile values calculated from the corresponding respective first sampled output values of the adjacent nozzles. If the first sampled output value of a current nozzle is not greater than the corresponding $80^{th}$ percentile value or less than the corresponding 20th percentile value, then in step 1440 the next sampled output value from the current nozzle being tested is compared with the corresponding next $80^{th}$ and $20^{th}$ percentile values. If the sample value is greater than the corresponding $80^{th}$ percentile value or less than the corresponding $20^{th}$ percentile value, then in step 1450, if the sample value of the nozzle being tested is greater than the $80^{th}$ percentile value, then in step 1470 a quadratic sum is formed of the difference between the $80^{th}$ percentile value and the corresponding sample value. If in step 1450 the sample value is less than its corresponding $80^{th}$ percentile value, then in step 1460 a quadratic sum is formed of the difference between the sample value of the nozzle being tested and its corresponding $20^{th}$ percentile value. In step 1480, a square root is formed of the total squared error calculated in the previous steps. The square root calculated in step 1480 is the total integrated error calculated according to a third embodiment of the present convention.

Figure 15:
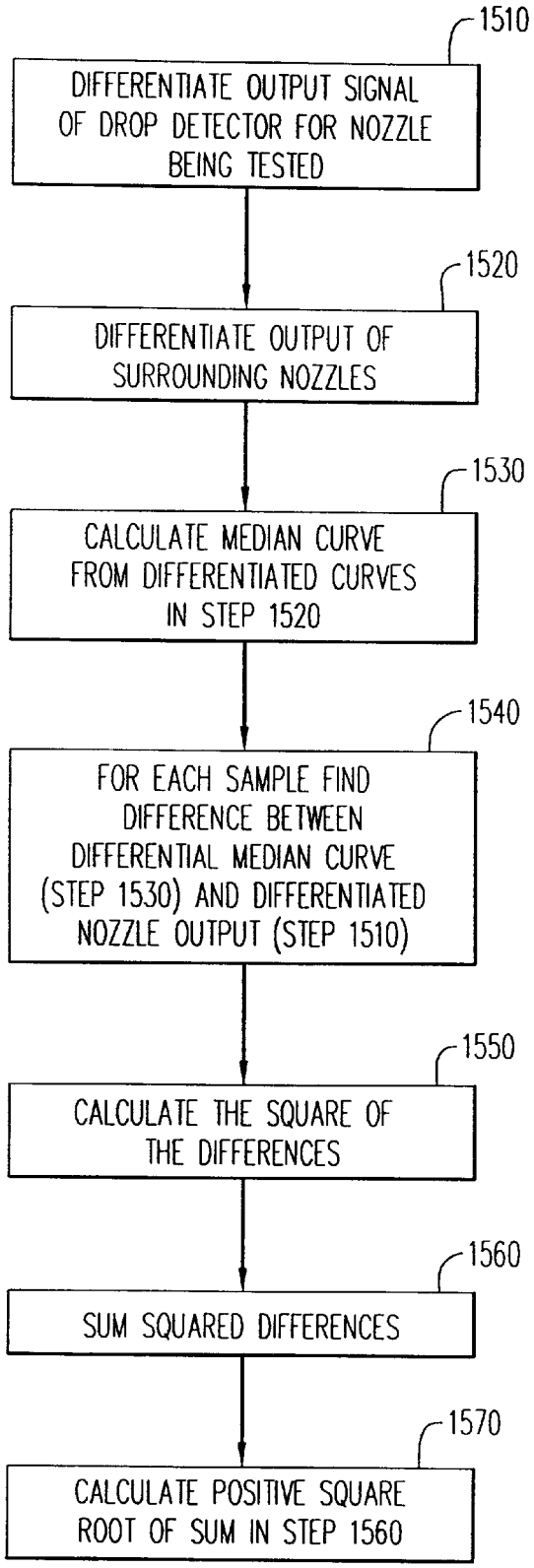
FIG. 15 illustrates schematically a fourth algorithm used for detecting anomalous nozzles according to a fourth specific method of the present invention.

Referring to FIG. 15 herein, there is illustrated schematically a fourth algorithm used to calculate the total error signal according to a fourth embodiment of the present invention. In step 1510, the sequence of 64 sampled output values corresponding to the outputs generated by a sequence of ink droplets ejected by one nozzle of the plurality of nozzles is differentiated with respect to time. Similarly, in step 1520, the time sequences corresponding to each respective 64 samples of a plurality of substantially adjacent nozzles are also differentiated with respect to time. Each nozzle of the plurality of nozzles comprising the printer head is tested by comparing its output signal with corresponding respective output signals of a plurality of nozzles in a same row as the nozzle to be tested and which are substantially adjacent to the nozzle to be tested. Preferably, the output signal of the nozzle to be tested is compared with output signals generated by the twenty nearest nozzles located on either side of the nozzle to be tested and which lie in the same row as the nozzle being tested. By way of example, considering the case where nozzle number 50 is currently being tested and is compared with output signals generated by ink droplets ejected from all even numbered nozzles having identifying numbers between 10 and 48 and between 52 and 90. In a case where a nozzle to be tested lies less than twenty nozzles away from either end of a row of nozzles in the printer head, the selection of nozzles used to compare with the nozzles being tested is as follows.

The total number of nozzles used to compare with the nozzle being tested remains constant. If, for example, the current nozzle being tested has a nozzle number 10, then the nozzles used to compare with the nozzle being tested are nozzles identified by the numbers 2, 4, 6, 8 and 12, 14 . . . 78, 80.

In step 1530, the median curve is calculated by taken a median of the differentiated output signals of a plurality of nozzles in the same row as the nozzle being tested. In step 1540, a difference is calculated between a differentiate output value of the current nozzle being tested and a corresponding output value of the median curve calculated in step 1530. Each difference signal is stored in a memory register. In step 1550, a square of each difference signal is calculated and stored. In step 1560, a sum is formed of the squared difference signals. In step 1570, a positive square root is calculated from a sum of the squared differences calculated in step differences calculated in step 1560.

Figure 16:
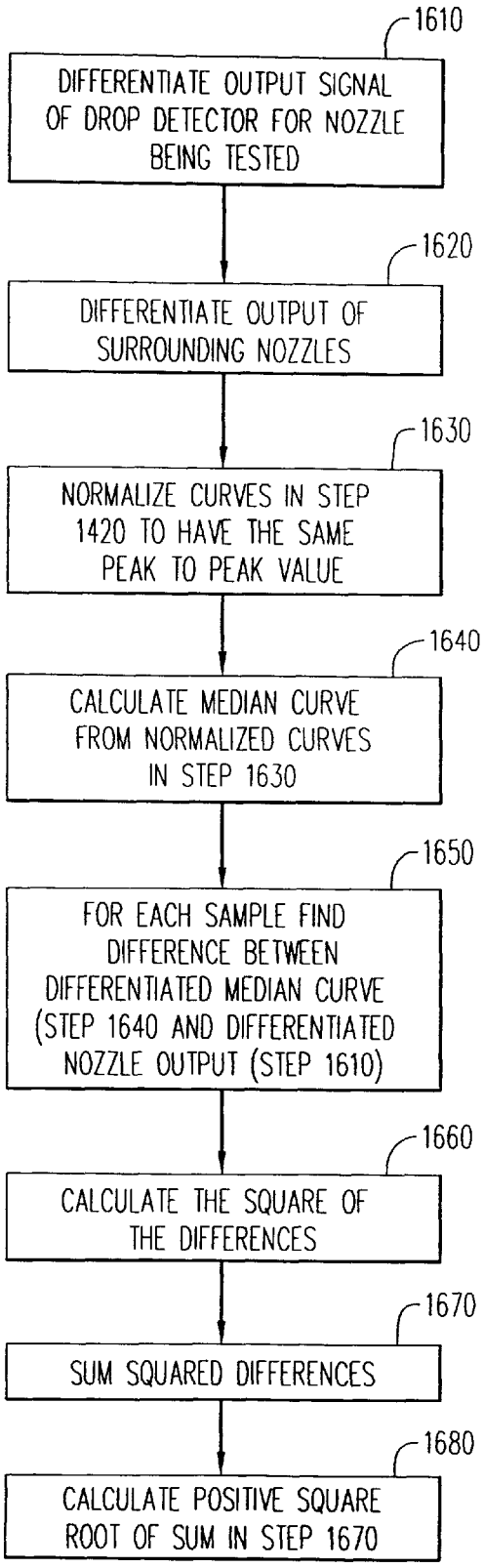
FIG. 16 illustrates schematically a fifth algorithm used for detecting anomalous nozzles according to a fifth specific method of the present invention.

Referring to FIG. 16 herein, there is illustrated schematically a fifth algorithm used to calculate a total error signal according to a fifth embodiment of the present invention. In step 1610, an output signal of a current nozzle being tested is differentiated. In step 1620, each nozzle of the plurality of nozzles is tested by comparison with differentiated output signals of a plurality of nozzles in the same row as the nozzle to be tested and which lie substantially adjacent to the nozzle being tested. Preferably, the differentiated output signal is compared with corresponding respective differentiated output signals generated in response to ink droplets fired from the twenty nearest nozzles located on either side of the nozzle being tested and in the same row as the nozzle being tested. By way of example, considering the case where a nozzle number 50 is currently being tested, this signal is compared with signals corresponding to drops ejected by all even numbered nozzles having identifying numbers between 10 and 48 and between 52 and 90.

In a case where a nozzle to be tested lies less than twenty nozzles away from either end of the row of nozzles in the printer head, the selection of nozzles used to compare with the nozzle being tested is as follows:

The total number of nozzles used to compare with the nozzle being tested remains constant. If, for example, the current nozzle being tested has a nozzle number 10, then this nozzle is compared with the corresponding output signals relating to nozzles 2, 4, 6, 8 and 12, 14 . . . 78, 80.

In step 1620, the output signals of the substantially adjacent nozzles are differentiated. In step 1630, the differentiated output curves of the adjacent nozzles are normalized such that each curve has a same peak-to-peak value. In step 1640, a median curve is calculated from the normalized curves calculated in step 1630. In step 1650, a difference is calculated between a sampled value of the output signal of the current nozzle being tested and the corresponding median value calculated in step 1640. As described earlier, the amplified output signal of the photodiode detector 460 is sampled 64 times by A/D converter 420. Hence, in step 1650 there are calculated 64 difference signal values between a median output signal and an output signal corresponding to the current nozzle being tested. In step 1660, each of the difference signals calculated in step 1650 are squared and in step 1660 a sum of the squared differences is calculated. In step 1680, the positive square root of the summed, squared differences between the median output signal and the output signal of current nozzle being tested is calculated. Hence, in step 1680 a total integrated error is calculated for a nozzle of the plurality of nozzles comprising the printer head.

What is claimed is:

1. A method of determining an operating characteristic of a printer head comprising a plurality of nozzles each configured to eject a plurality of droplets of ink, said method comprising the steps of:

detecting a signal resulting from ejection of a predetermined sequence of ink drops from a selected said nozzle;

for each of a set of said plurality of said nozzles, detecting a corresponding respective signal resulting from ejection of a corresponding predetermined sequence of ink drops;

determining a generic signal response from said plurality of detected signal responses of said set of nozzles; and comparing said detected signal of said selected nozzle with said generic signal determined from said set of nozzles.

2. The method as claimed in claim 1, further comprising the step of:

determining a difference between said signal of said selected nozzle and said generic signal determined from said set of nozzles.

3. A method for checking a functionality of a selected nozzle of a printer head containing a plurality of nozzles configured to eject droplets of ink, said method comprising the steps of:

sending an instruction to said printer head to eject a predetermined sequence of droplets of ink from said selected nozzle;

generating an output signal from a detecting means configured to detect a passage of said predetermined sequence of droplets of ink past said detecting means, wherein all of said droplets in said sequence are transiently within a detection zone of said detecting means at a same time; and applying an algorithm to said output signal to generate an error signal that identifies an anomalous behavior of said selected nozzle.

4. The method as claimed in claim 3, wherein said predetermined sequence of ink droplets comprises at least one droplet of ink configured such that a total volume of ink of said predetermined at least one droplet lies within a specified range of volume.

5. The method as claimed in claim 3, wherein a total volume of ink contained in said predetermined sequence of droplets is configured to produce an output signal having a substantially larger amplitude than a typical noise amplitude introduced by said detecting means.

6. The method as claimed in claim 3, wherein said predetermined sequence of ink droplets contain a total ink volume substantially within the range 1 picolitres to 100 picolitres.

7. The method as claimed in claim 3, wherein said step of applying an algorithm to said output signal comprises calculating a median output signal from a plurality of output signals corresponding to said set of nozzles.

8. The method as claimed in claim 3, wherein said selected nozzle comprises an anomalous nozzle, said anomalous nozzle having a malfunction selected from the group consisting of:

in use, ejecting an ink droplet of a lower than expected ink volume;

in use, ejecting an ink droplet of a higher than expected ink volume;

in use, operating intermittently;

in use, operating unreliably; and in use, ejecting a misdirected ink droplet with deviates from a predetermined trajectory path.

9. The method of claim 3, wherein said method is repeated for another nozzle of said plurality of nozzles.

10. The method as claimed in claim 3, wherein said step of applying an algorithm to said output signal comprises the steps of:

for each nozzle of a set of said plurality of nozzles that lie adjacent to said selected nozzle, generating an output signal in response to a predetermined sequence of ink droplets ejected from said each nozzle of said set;

for each generated output signal of said set of nozzles, calculating a first percentile value;

for each said generated output signal of said set of nozzles, calculating a second percentile value;

determining whether an output of said detecting means is greater than said first percentile value or less than said second percentile value;

if said output of said detecting means is less than said second percentile value then calculating a difference value between said output of said detecting means and said second percentile value, and squaring said difference value;

if said output of said detecting means is greater than said first percentile value calculating a difference value between said output of said detecting means and said first percentile value and squaring said difference value;

adding said squared difference values; and calculating a positive square root of said summed squared difference values.

11. The method as claimed in claim 3, wherein said step of applying an algorithm to said output signal comprises:

for each nozzle of a set of said plurality of nozzles that lie adjacent to said nozzle, generating an output signal in response to a predetermined sequence of ink droplets ejected from said each nozzle of said set;

differentiating each said output signal of said detecting means for each nozzle of said set of nozzles;

differentiating said output signal obtained in response to said selected nozzle;

calculating an average differentiated output signal from said plurality of differentiated output signals;

calculating a difference between said differentiated output signal of said selected nozzle and said differentiated average output signal;

squaring said difference between said differentiated output signal of said selected nozzle and said differentiated average output signal;

summing said squared difference; and calculating a positive square toot of said summed squared difference.

12. The method as claimed in claim 3, wherein said step of applying an algorithm to said output signal comprises:

for each nozzle of a set of said plurality of nozzles that lie substantially adjacent to said selected nozzle, generating an output signal in response to a predetermined sequence of ink droplets ejected from said each nozzle of said set;

differentiating said output signal obtained in response to operation of said selected nozzle;

differentiating each of said output signals obtained in response to ink droplets ejected from said set up of nozzles;

normalising said differentiated output signals of said substantially adjacent nozzles such that said plurality of differentiated output signals have a same peak-to-peak value;

calculating an average differentiated signal from said plurality of nornalised differentiated output signals;

calculating a difference between said differentiated output signal of said selected nozzle and said averaged differentiated output signal;

calculating a squared value of said difference;

summing said squared difference; and calculating a positive square root of said summed, squared difference.

13. A method for checking a functionality of at least one selected nozzle of a printer head containing a plurality of nozzles configured to eject droplets of ink, said method comprising the steps of:

for each nozzle of a set of nozzles of said plurality of nozzles, sending an instruction to a print head to eject a predetermined sequence of ink droplets from said nozzle;

for each nozzle of said set, generating a corresponding respective output signal from said detecting means; and applying an algorithm to said output signal to generate an error signal that identifies an anomalous behavior of said at least one selected nozzle, wherein said step of applying an algorithm to said output signal comprises the steps of:

(A) for each of a plurality of sample intervals:

(i) determining an average output signal of said detecting means for a plurality of output signals corresponding to said set of nozzles;

(ii) calculating a difference between said average output signal and an output signal of said detecting means corresponding to said at least one selected nozzle; and (iii) calculating a square of said difference between said average output signal and said output signal of said selected nozzle;

(B) summing said squared differences for said at least one selected nozzle from said plurality of sample intervals; and (C) calculating a positive square root of said summed squared differences.

14. A method for checking a functionality of a selected nozzle of a printer head containing a plurality of nozzles configured to eject droplets of ink, said method comprising the steps of:

sending an instruction to said printer head to eject a predetermined sequence of droplets of ink from said selected nozzle;

generating an output signal from a detecting means configured to detect a passage of said predetermined sequence of droplets of ink past said detecting means; and applying an algorithm to said output signal to generate an error signal that identifies an anomalous behavior of said selected nozzle, wherein said step of applying an algorithm to said output signal comprises:

finding a maximum value of said output signal of said detecting means corresponding to said selected nozzle;

finding a minimum value of said output signal from said detecting means corresponding to said selected nozzle;

calculating a peak-to-peak difference value between said maximum output signal value and said minimum output signal value of said selected nozzle;

for each of a set of said plurality of nozzles located substantially adjacent said selected nozzle, finding a maximum value of an output signal of said detecting means generated in response to a corresponding respective predetermined sequence of ink droplets ejected from each nozzle in said set, and finding a minimum value of said output signal for each nozzle in said set;

for each nozzle of said set of nozzles, calculating a respective peak-to-peak output signal value;

calculating an average peak-to-peak value from said plurality of peak-to-peak signal values of said set of nozzles; and calculating a difference value representing a difference between said peak-to-peak signal value of said selected nozzle, and said average peak-to-peak signal value of said set of nozzles.

15. A method of determining an operating characteristic of a selected nozzle of an ink jet head device comprising a plurality of nozzles, said method comprising the steps of:

obtaining for each nozzle of a set of nozzles, a corresponding respective nozzle signal output from a detecting means configured to detect a passage of at least one droplet of ink ejected from said nozzle, thus yielding a plurality of nozzle signals;

obtaining for a selected nozzle a selected nozzle signal output from said detecting means;

determining an amount of perturbation signal determined from said plurality of nozzle signals;

comparing said perturbation signal of said selected nozzle signal with said genetic perturbation signal; and determining whether said selected nozzle is operating satisfactorily, based on said comparison of perturbation signals.

16. A method of determining an operating characteristic of an ink jet printer head comprising a plurality of nozzles, said method comprising the steps of:

for each said nozzle, ejecting a predetermined sequence of ink droplets;

for a selected said nozzle, generating a corresponding respective perturbation signal having a perturbation produced in response to a said predetermined sequence of ink droplets ejected from said selected nozzle;

from said perturbation signal of said selected nozzle, generating a magnitude signal representing a magnitude of said perturbation;

for each of a set of said nozzles, generating a corresponding respective perturbation signal having a perturbation produced in response to a said predetermined sequence of ink droplets ejected from said nozzle;

generating a generic magnitude signal determined from said plurality of perturbation signals of said set of nozzles; and for said selected nozzle generating an error signal determined from said magnitude signal of said perturbation of said selected nozzle and said generic magnitude signal.

17. The method as claimed in claim 16, wherein said step of generating a magnitude signal comprises performing a plurality of amplitude samples over a plurality of time intervals on said perturbation signal.

18. The method as claimed in claim 16, wherein said plurality of nozzles are arranged in at least one row on said print head, and said generic magnitude signal is determined from a plurality of signal responses corresponding to ink droplets ejected from a plurality of nozzles in a same said row.

19. The method as claimed in claim 16, wherein said plurality of nozzles are arranged in at least one row on said print head, and said generic magnitude signal is determined from signals of a plurality of nozzles of a same row as a said selected nozzle, and extending on each side of said selected nozzle.

20. The method as claimed in claim 16, wherein said generic magnitude signal is determined as a median magnitude of said plurality of perturbation signals of said set of nozzles.

21. A method of detecting at least one anomalous nozzle of an ink jet printer device having (a) a plurality of nozzles arranged substantially in at least one row, and (b) a means for detecting a drop of ink ejected from a nozzle, said method comprising the steps of:

selecting a nozzle of said plurality of nozzles;

finding a maximum value of an output signal of said detecting means corresponding to said selected nozzle;

finding a minimum value of said output signal from said detecting means corresponding to said selected nozzle;

calculating a peak-to-peak difference value between said maximum output signal value and said minimum output signal value of said selected nozzle;

for each of a set of said plurality of nozzles located substantially adjacent said selected nozzle, finding a maximum value of an output signal of said detecting means generated in response to a corresponding respective predetermined sequence of ink droplets ejected from each nozzle in said set, and finding a minimum value of said output signals for each nozzle in said set;

for each nozzle of a said set of nozzles, calculating a respective peak-to-peak output signal value;

calculating an average peak-to-peak signal value from said plurality of peak-to-peak signal values of said set of nozzles; and calculating a difference between said peak-to-peak signal value of said selected nozzle, and said average peak-to-peak signal value of said set of nozzles.

* * * * *